US007891667B2

(12) United States Patent
Lowrance

(10) Patent No.: US 7,891,667 B2
(45) **Date of Patent: *Feb. 22, 2011**

(54) GAME IMITATING THE CATCHING OF FISH BY PLUG CASTING

(76) Inventor: Arlen J. Lowrance, 12 S. Coventry Ct., Edmond, OK (US) 73012

( * ) Notice: Subject to any disclaimer, the term of this patent is extended or adjusted under 35 U.S.C. 154(b) by 0 days.

This patent is subject to a terminal disclaimer.

(21) Appl. No.: 12/488,401

(22) Filed: Jun. 19, 2009

(65) Prior Publication Data

US 2010/0013161 A1 Jan. 21, 2010

Related U.S. Application Data

(63) Continuation-in-part of application No. 12/002,221, filed on Dec. 17, 2007, now abandoned, which is a continuation-in-part of application No. 11/903,701, filed on Sep. 25, 2007, now Pat. No. 7,484,733, which is a continuation-in-part of application No. 11/788,271, filed on Apr. 19, 2007, now Pat. No. 7,392,987.

(51) Int. Cl.
*A63F 9/30* (2006.01)

(52) U.S. Cl. ..... 273/343

(58) Field of Classification Search ..... 273/317, 273/331, 333, 343, 348, 391, 393, 407, 140, 273/440, 447

See application file for complete search history.

(56) References Cited

U.S. PATENT DOCUMENTS 2,320,145 A * 5/1943 La Due ..... 273/350
2,343,002 A * 2/1944 Colaluca ..... 273/393
2,393,726 A * 1/1946 Yejoff ..... 273/140
2,482,057 A * 9/1949 Fincke ..... 273/393
2,511,430 A * 6/1950 Colaluca ..... 273/393
2,598,487 A * 5/1952 Anechiarico ..... 446/132
2,611,617 A * 9/1952 Strohm ..... 273/140
2,703,469 A * 3/1955 Raizen ..... 446/153
3,463,494 A * 8/1969 Stroh ..... 273/348.3
3,620,532 A * 11/1971 Graf et al. ..... 273/447
3,788,641 A * 1/1974 Lemelson ..... 273/448
4,976,439 A * 12/1990 Kraemer ..... 273/350
5,094,461 A * 3/1992 Lowrance ..... 273/343
5,180,170 A * 1/1993 Lowrance ..... 273/343
5,310,193 A * 5/1994 Lowrance ..... 273/393
5,367,503 A * 11/1994 Lowrance ..... 368/10
5,657,995 A * 8/1997 Howard ..... 273/333
6,726,207 B1 * 4/2004 Jacobus ..... 273/343

* cited by examiner

*Primary Examiner*—Raleigh W. Chiu
(74) *Attorney, Agent, or Firm*—Fellers, Snider, Blankenship, Bailey & Tippens, P.C.; Terry L. Watt

(57) ABSTRACT

A fishing apparatus for simulating the catching of fish is taught herein. A preferred embodiment comprises a horizontal fish support, one or more fish-shaped members releasably mounted on the fish support, each fish-shaped member having a tapered mouth extending in front of the fish's mouth and a line slot that terminates in a patch of hook and loop material. A cast plug will carry a mating patch of the same material so that when the plug is drawn toward the user through the guide slot, the plug will engage the fish-shaped member, thereby pulling it away from the fish support in a manner simulating the catching of fish in actual water.

18 Claims, 33 Drawing Sheets

GAME IMITATING THE CATCHING OF FISH BY PLUG CASTING

This application discloses an invention which is an improvement over the invention set forth in my prior U.S. Pat. No. 5,094,461, issued Mar. 10, 1992, on "Fishing Game Apparatus." This application is a continuation-in-part of co-pending U.S. Ser. No. 12/002,221 for "Game Imitating The Catching of Fish By Plug Casting," filed Dec. 17, 2007, which is a continuation-in-part of my issued application Ser. No. 11/903,701, filed on Sep. 25, 2007, now U.S. Pat. No. 7,484,733 B2, issued Feb. 3, 2009, which in turn is a continuation-in-part of my issued application Ser. No. 11/788,271 filed on Apr. 19, 2007, now U.S. Pat. No. 7,392,987 B1, issued Jul. 1, 2008.

BACKGROUND OF THE INVENTION

1. Field of the Invention

The present invention relates to an apparatus or device which can be used to simulate fishing. More particularly, the apparatus of the present invention includes one or more artificial fish which are temporarily retained on a support and which are removed from the support using an operation which is similar to the action of fishing by casting a plug. The present application adds to application Ser. No. 11/788,271 the subject matter in four main areas:

(1) The game is provided with new supporting structure for the game itself as well as the game board;

(2) The game board is supported in a slightly different manner from the new support;

(3) The support for the game is modified such that parts of the game apparatus can be filled with floatable material so that the supporting structure can float on the surface of the water in which case the game board and wallpaper are omitted; and, (4) The mouth piece for snaring the fish (as opposed to the mouth for the fish per se) is separable from the fish.

2. Prior Art

There are numerous games or devices wherein "fish" are involved as game pieces or tokens. However, the prior art does not disclose a fishing device or apparatus of the type disclosed herein. Actually, the closest prior art is set forth in applicant's own patent and the two pending applications all referred to above.

SUMMARY OF THE INVENTION

The present invention involves a fishing device or apparatus wherein one or more flat vertical objects resembling fish are arranged in a horizontal row along a support. Each "fish" is provided with a releasable holding means for connecting the fish to its support. In one form of the invention, the releasable holding means consists of circular support openings in the fish, the support openings being removably received on or over a button or grommet, which, in turn, is received in a slot on the fish support; other releasable holding means include spaced clips mounted on the fish support and forming slots for receiving the sides of the fish shaped member therein. Other releasable holding means can be strips or patches of VELCRO® or even magnets. Each fish is also provided with an inclined entrance opening at the forward end of the fish. The center portion of each entrance opening is provided with a guide slot which connects with a circular snare opening located near the mouth of the fish. For the purpose of catching the fish, the would-be fisherman, or player, will utilize a casting rod with a winding reel, which form no part of this invention. The end of the line which connects with the fishing rod and the reel, however, will be provided with a plug which cooperates with the circular snare opening immediately below (or behind) the entrance opening of the fish. The plug is made of resilient material, such as rubber or plastic, and is provided with a nose piece adjacent the connection of the line to the plug. This nose piece is tapered from a diameter of smaller size than the snare opening in the fish to a diameter slightly larger than the diameter in the snare opening. Immediately beyond the larger diameter of the nose piece, the plug is provided with a recess so that when the plug is pulled into the snare opening, the nose piece will squeeze through the opening until the sides of the opening are lodged in the recess. Further pulling on the line will pull the fish off the support and the fish is now "caught".

In order to assist the fisherman in directing his line into the guide slot and circular snare opening of each fish, the support is located to the rear of an essentially vertical game board or surface which includes at least one vertical gap which is ultimately in alignment with the guide slot in the fish. In one form of the invention, the game board is provided with a single vertical gap extending between two doors which are mounted for swinging opening movement along vertical hinge axes. The entire game board including the surfaces of the two doors is provided with a plastic film, or "wallpaper" on which scenes from a lake or seaside are depicted to provide reality to the game. The upper edges of the game board are tapered inwardly on opposite sides of the gap so that a fisherman, if he gets his line over the upper end of the game board, can manipulate the line, by sidewise tugging, into the gap.

In another form of the invention the game board comprises a plurality of doors which are mounted for swinging opening movement along horizontal hinge axes. A vertical gap is provided between each pair of adjacent doors. An optional flexible and adjustable plastic loop can be located at the upper end of the game board to provide a target for the fisherman to cast his plug between the loop and the upper end of the game board. This target loop can be inverted to provide a long distance casting target. The fish are mounted on a horizontal support behind and parallel to the game board. The guide slots in the fish are in alignment with the gaps in the game board.

Other variations in the invention include a new supporting structure for the game itself as well as the game board which permits the frame of the game to be impaled into the ground; the support for the game is modified such that parts of the game apparatus can be filled with floatable material so that the supporting structure can float on the surface of the water in which case the game board and wallpaper are omitted; and the mouth piece for snaring the fish (as opposed to the mouth for the fish per se) is separable from the fish.

Finally, there is provided another embodiment substantially as described above, wherein a hook and loop material (e.g., Velcro®) is used to attach the fish-like gaming piece to the support bar and/or used to engage the game piece and pull it toward the user when a successful catch has been made. In the preferred embodiment, the plug that is cast by the user will contain a circular (or other shaped) patch of hook and loop material that is selected to engage a corresponding piece on the fish. Additionally, it is preferred that a weight of some sort be affixed proximate to the end of the fishing line to assist the game player in casting the line toward the game apparatus.

In broadest terms, it should be noted and remembered that each of the foregoing embodiments is similar in that the fish game piece is engaged from a side opposite the game participant. That is, it is critical to the operation of the instant invention that the user cast a fishing line with a weighted engaging member affixed thereto past the game piece(s). The engaging member is then drawn back toward the player and engages the fish game piece from a side opposite the player. Whether such engagement is accomplished by wedging a plug into a snare opening or by mating together two complimentary pieces of hook and loop material, magnets, etc., that engagement must be made by casting a weighted plug beyond the target and then drawing it back toward the user until the game piece is engaged and then, subsequently, drawn to the user.

The foregoing has outlined in broad terms the more important features of the invention disclosed herein so that the detailed description that follows may be more clearly understood, and so that the contribution of the instant inventors to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Further, the disclosure that follows is intended to be pertinent to all alternatives, modifications and equivalents as may be included within the spirit and scope of the invention as defined by the appended claims. Finally, it should be understood that the phraseology and terminology employed herein are for the purpose of description and should not be regarded as limiting, unless the specification specifically so limits the invention.

While the instant invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

Figure 1:
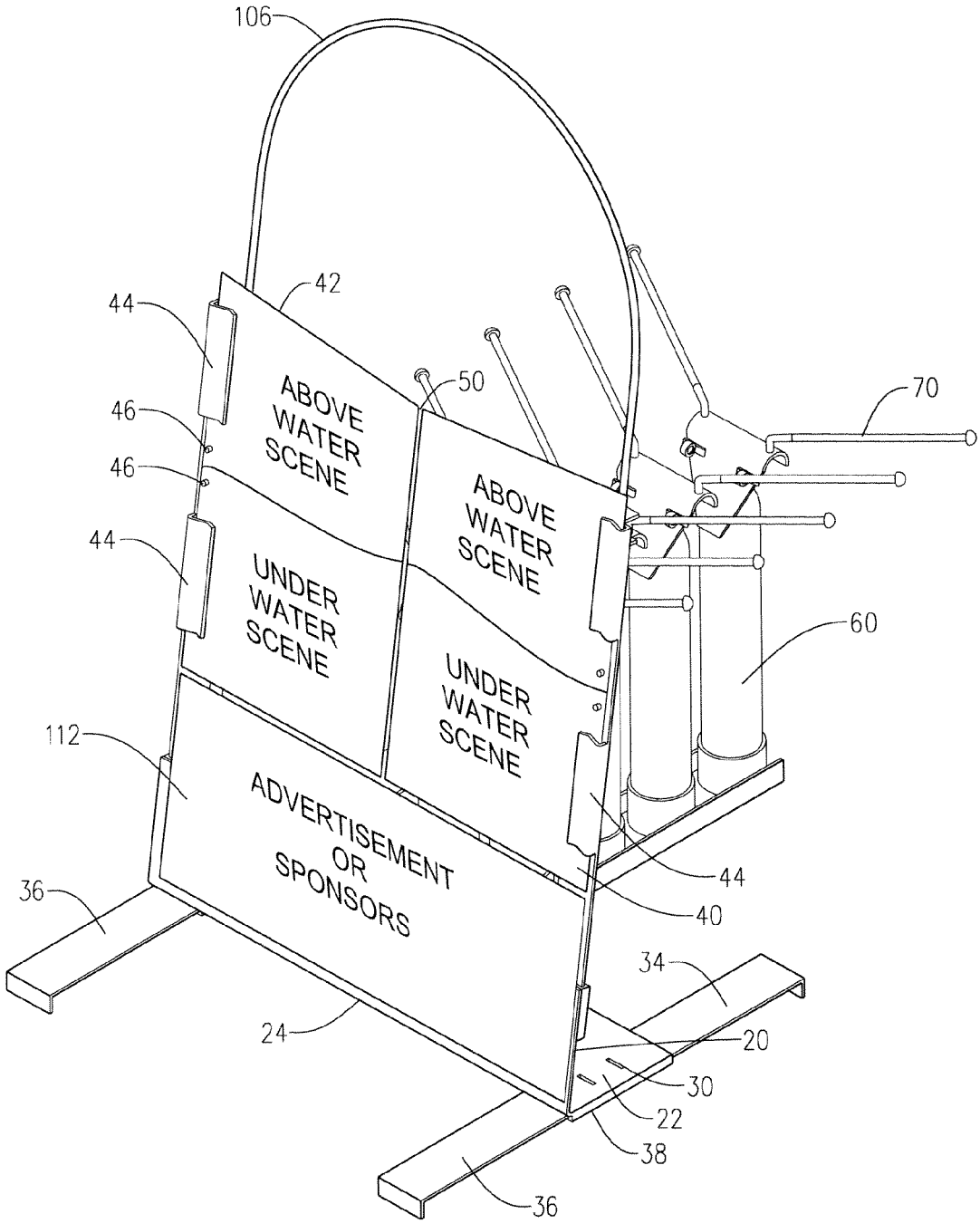
FIG. 1 is a front perspective view, of the present invention, with the back ground graphic being shown as legends on the doors and on the panel beneath the doors.

Referring to the drawings in detail, FIG. 1 shows a relatively flat game surface or board 20 which is disposed at a relatively large angle (preferably 45 degrees or more) with respect to a flat horizontal member 22 which is connected at its front 24 to the bottom of the game board 20. The members 20 and 22 can be formed in a single piece or they can be formed separately and connected together. The game board 20 also includes a pair of vertical supports 26 which are secured to the game board 20 by means of rectangular pockets 28. Each pocket 28 is provided with a slot 30 which cooperates with a ridge 32 on the vertical support 26. Thus, when the vertical support 26 is inserted into the pocket 28 the ridge 32 will engage the slot 30 and "lock" the vertical support 26 in position with respect to the vertical game board 20.

The horizontal member 22 is provided with rearwardly extending horizontal legs 34 and forwardly extending horizontal legs 36. These legs are received at opposite ends of a pocket 38 which is formed at the bottom of the member 22. Each pocket 38 is provided with a pair of slots 30 which cooperate with ridges 32 on the legs 34 and 36 in much the same manner as vertical support 26 cooperates with its pocket 28.

Figure 8:
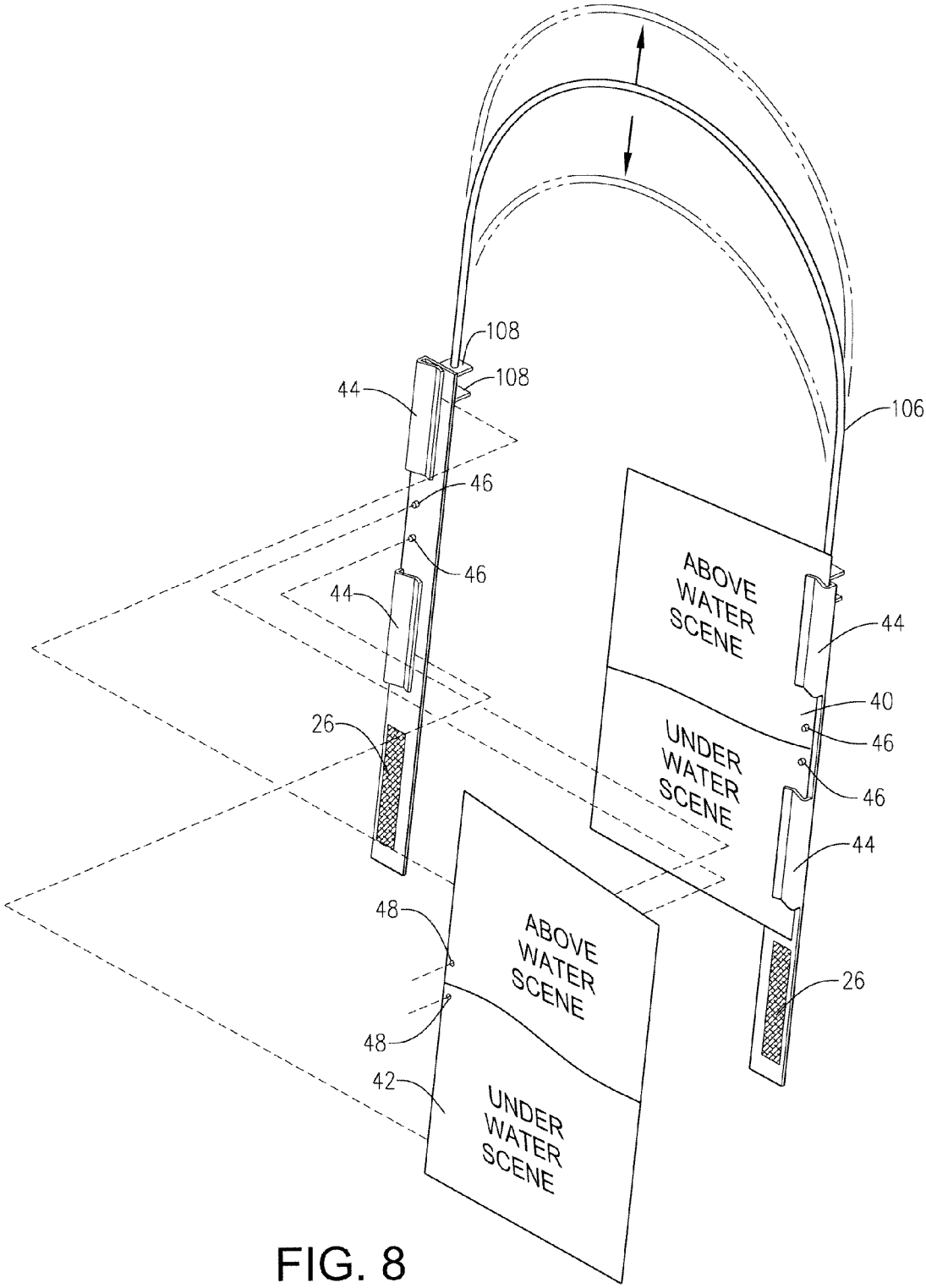
FIG. 8 is a partial front perspective view particularly of the doors associated with the game board.

The game board 20 has associated therewith a pair of doors 40 and 42 which are connected to the vertical supports 26 so as to swing hingedly with respect thereto. That is, the vertical uprights 26 (see now FIG. 8) are provided with clamps 44 at the upper and mid portions of the uprights 26 to engage the upper and lower side edges of the doors 40 and 42. For the purpose of keeping the doors in proper alignment with the vertical members 26, each vertical member 26 is provided with a pair of outwardly projecting pins 46 which are adapted to be received in holes 48 along the sides of the doors 40 and 42.

Figure 2:
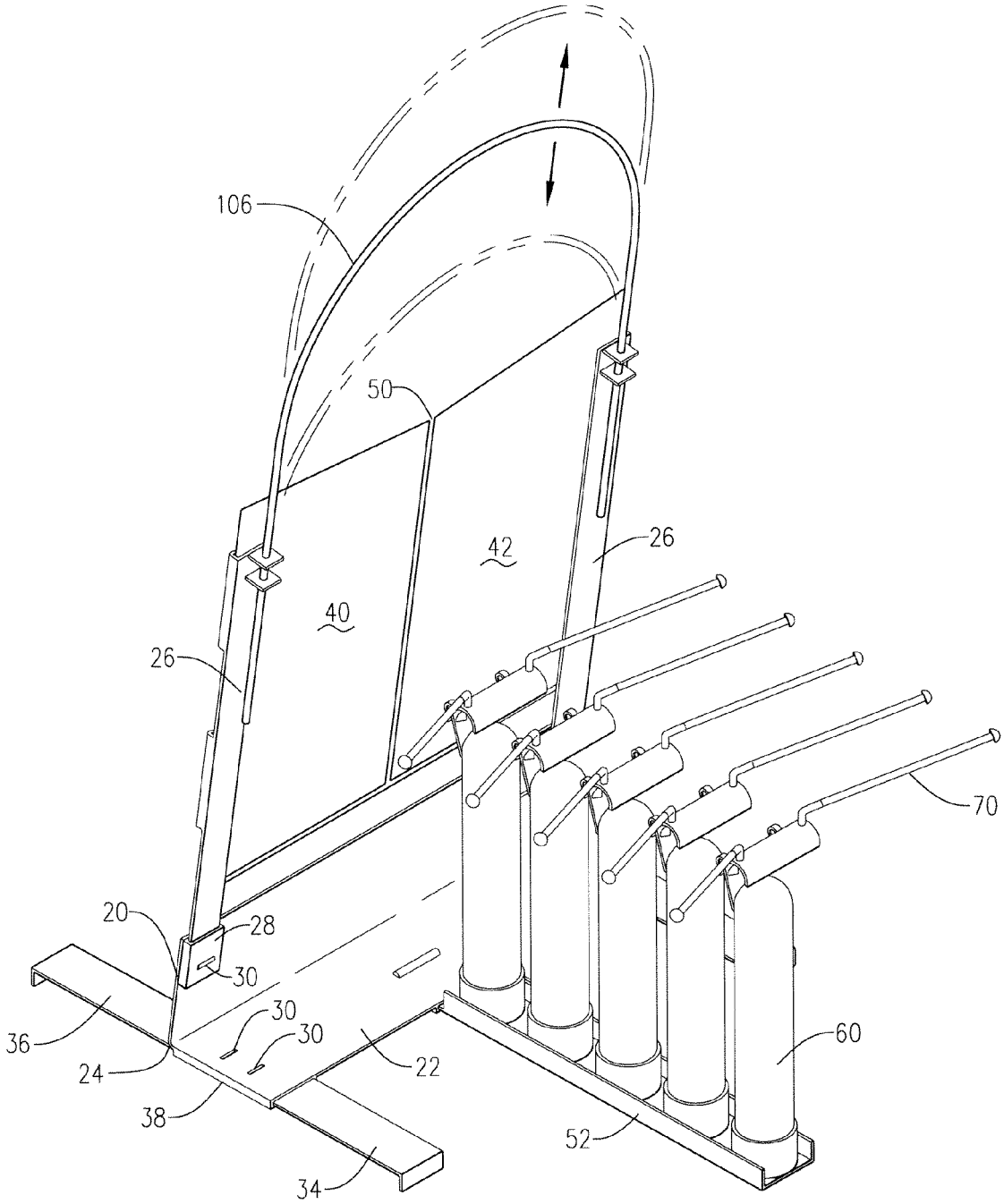
FIG. 2 is a rear perspective view, of the invention shown in FIG. 1.
Figure 3:
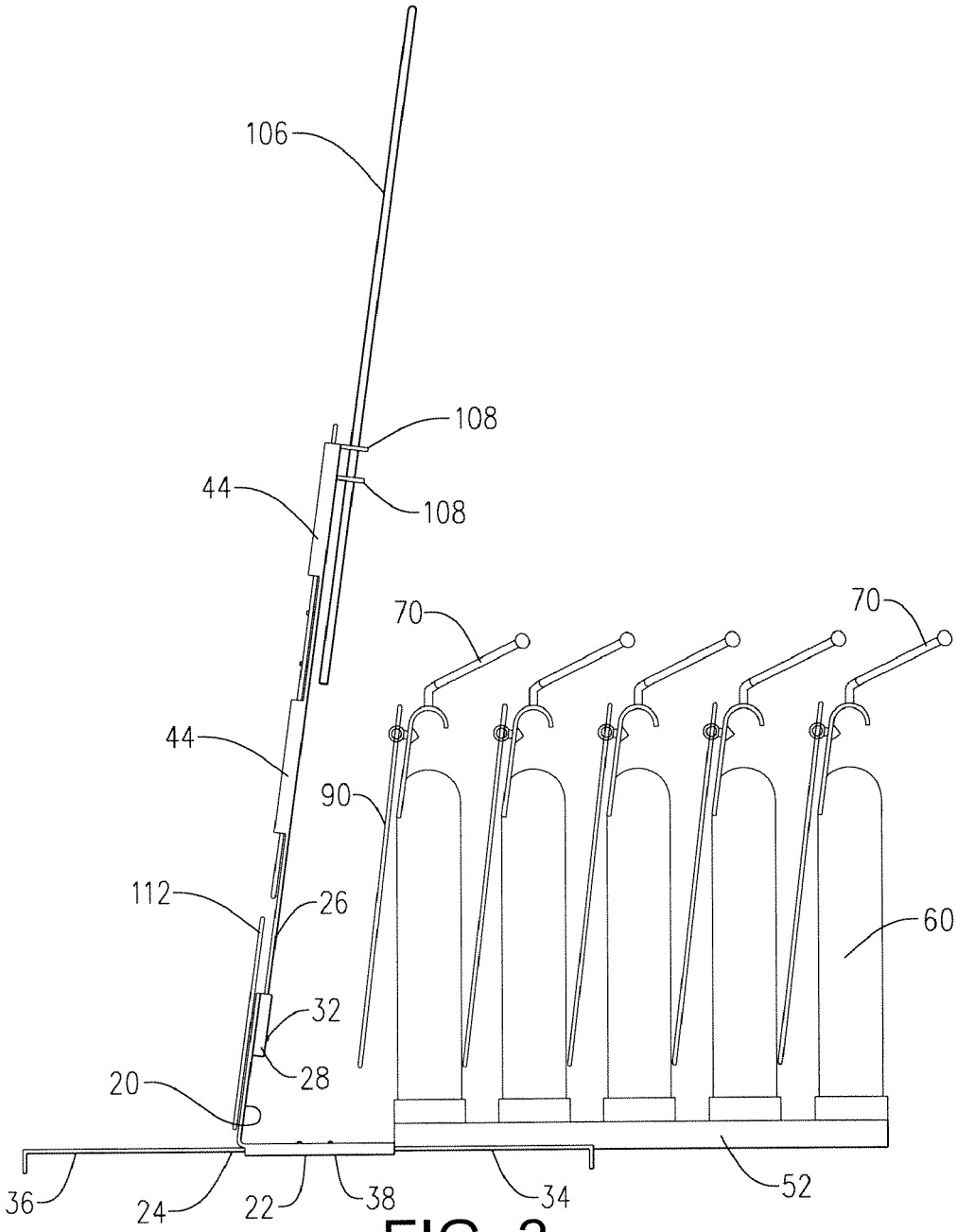
FIG. 3 is a right side elevation taken from FIG. 1.

Turning now to FIGS. 1 and 2, the vertical space between the doors 40 and 42 can be considered as a vertical gap 50 which will be aligned with a guide slot in the fish as will be later explained. Extending to the rear of the horizontal support 22 is a horizontal tray 52 having a forward projecting tab 54 and vertical sides 56. Spaced along the horizontal tray 52 between the vertical sides 56 are a plurality of circular sockets 58 which are adapted to receive a plurality of vertical tubes 60. The lower end of each vertical tube 60 is provided with a vertical slot 62 which is adapted to be received over a radial member 64 on the inside of the socket 58. The arrangement of the slot 62 and the radial member 64 is such that the lower end of the tube 60 is prevented from turning in the socket 58. The upper end of each tube is provided with an inclined triangular member 66 which is connected to the tube 60 in any convenient manner. Each triangular member 66 is provided with a pair of slots 68 which are adapted to receive a pair of grommets 71 for a purpose which will hereafter appear. The upper end of each triangular plate 66 is also provided with a pair of upwardly and outwardly diverging arms 70 which are provided with rounded buttons 72 at the end thereof to prevent snagging of the line.

Figure 7:
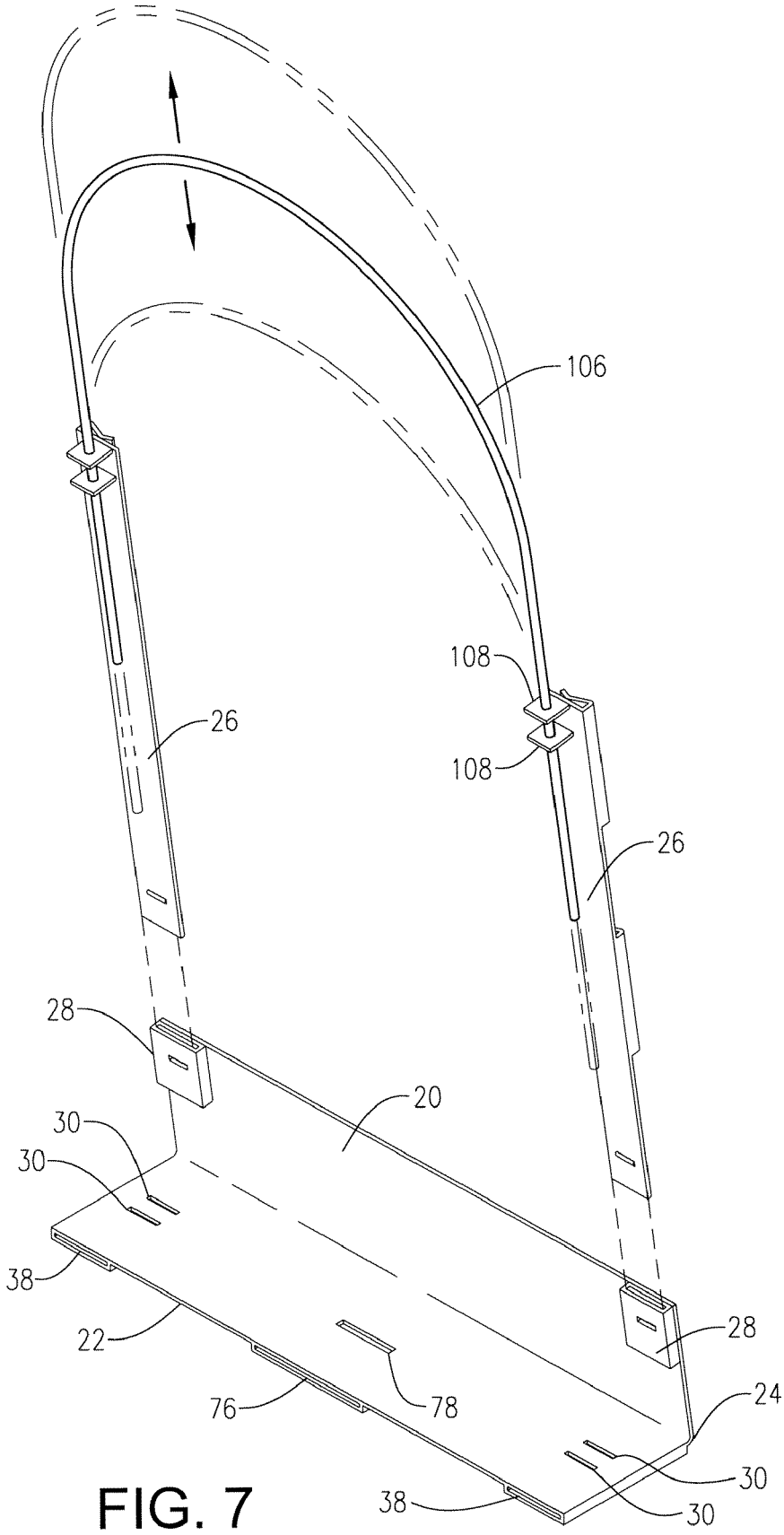
FIG. 7 is a rear perspective view of the game board and its supporting structure.

As best shown in FIG. 7, a pocket 76 is provided midway of the horizontal support 22 essentially equidistant from the pocket 38 but somewhat wider than the pockets 38. The pocket 76 is provided with a slot 78 which is somewhat longer than the slots 30 in the pockets 38. The forward end 54 of the horizontal tray 52 is adapted to be received in the pocket 76 and a ridge 80 thereon is adapted to engage the slot 78 of the pocket 76.

Figure 4:
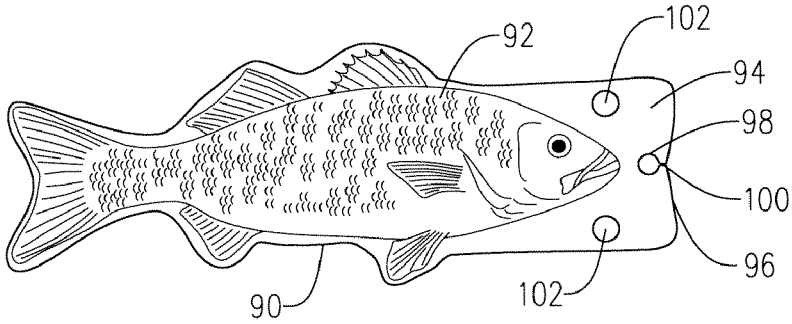
FIG. 4 is a plan view of one of the fishes used in the game of the present invention.
Figure 6:
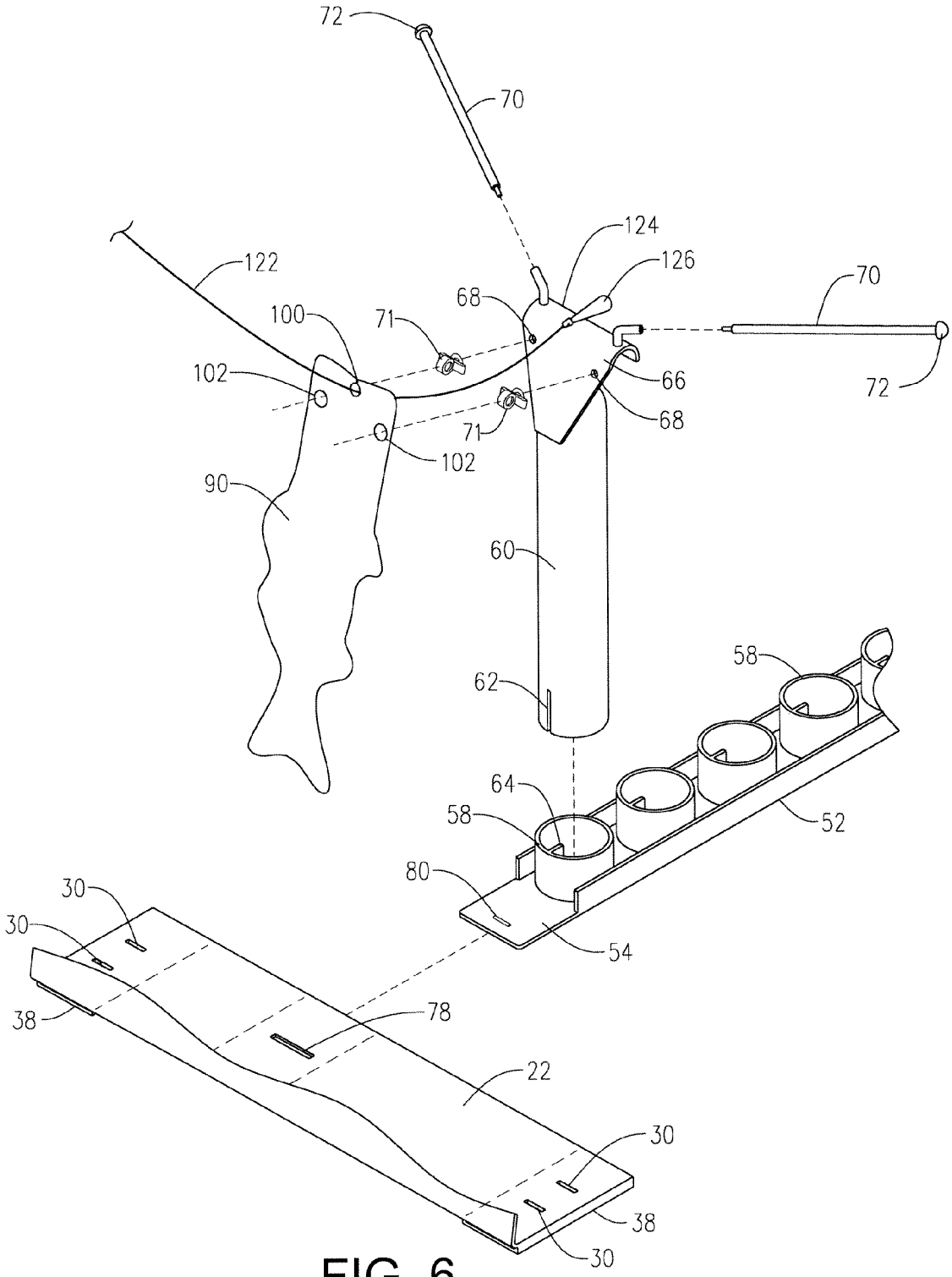
FIG. 6 is a partial exploded view of the sub-assembly for the fish support.

Turning now to FIG. 4, the game piece of the present invention is a fish shaped game piece 90 which has shows a depiction of a fish 92 thereon. However, the forward or right-hand end of the game piece 90 is provided with a projecting portion 94 which includes an inclined entrance opening 96 which leads to a snare opening 98 through a guide slot 100. The game piece 90 is also provided with a pair of support openings 102 on opposite sides and "below" the snare opening 98. As best shown in FIG. 6, the support openings 102 are adapted to fit over the grommets 71 which are attached to the inclined triangular plate 66. A flexible loop 106 extends above the vertical supports 26 and is attached thereto by means of tabs 108. The tabs are provided with holes through which the loop 106 may be inserted and which provide an adjustability as indicated by the dotted lines in FIG. 7.

Figure 5:
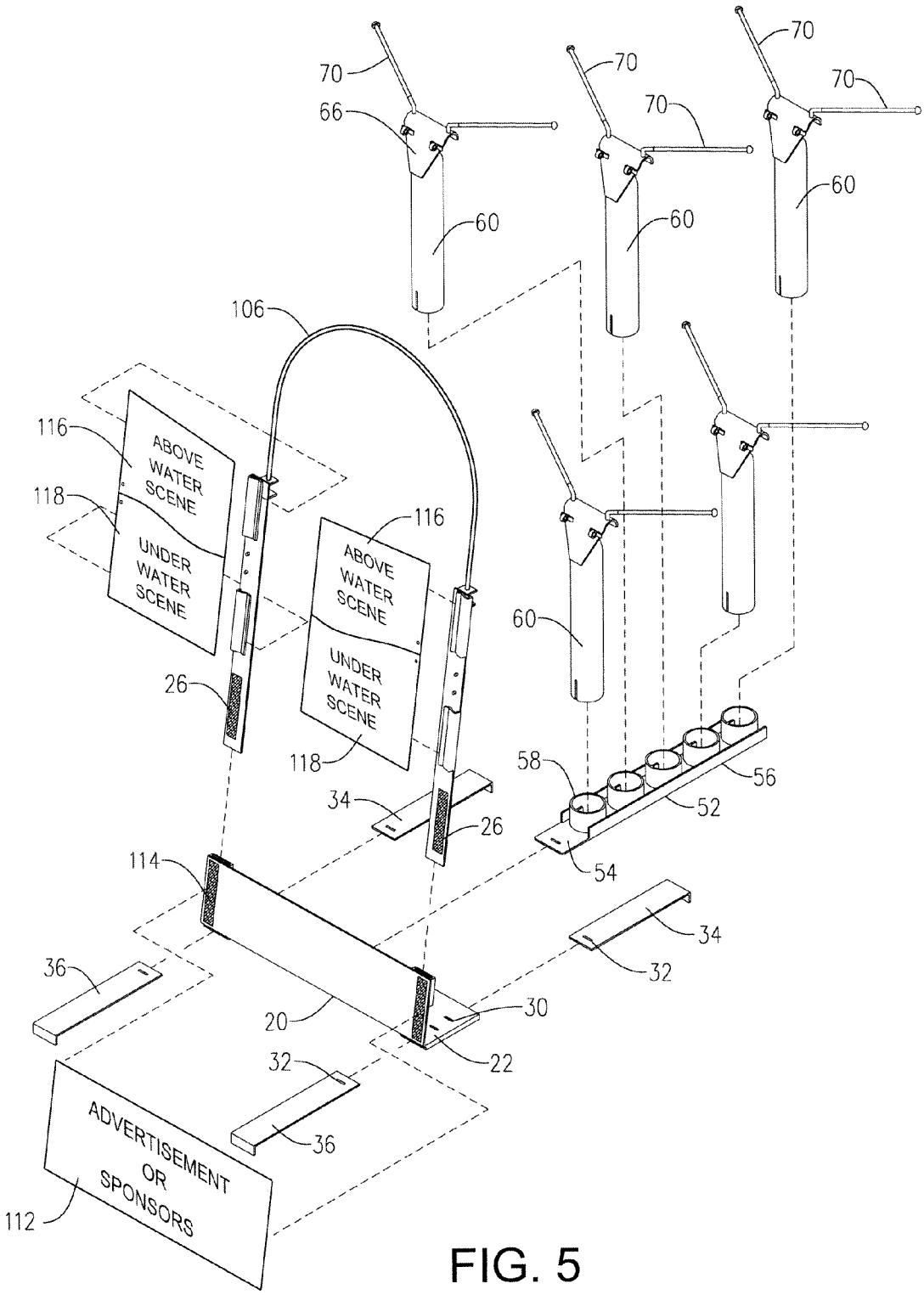
FIG. 5 is an exploded view taken from FIG. 1, showing how the various parts are assembled.

As best shown in FIG. 5, a vertical advertising plate 112 which is designed to have advertising thereon is attached to the vertical plate 20 by means of VELCRO strips or the like 114.

The doors 40 and 42 are covered with plastic film or sheets 116 and 118, which can sometimes be referred to as "wallpaper." The purpose of the film 116 and 118 is to provide a design thereon which will simulate that appearance of a lake or other fishing location. Preferably, the films 116 depict an above water scene whereas the films 118 depict a scene below the water.

The manner in which the fish 90 of the present invention are snared or caught will now be described in relation to FIGS. 6 and 9. The person playing this game or sport will use any conventional rod and reel (not shown) using a conventional fishing line 122 of suitable strength and durability. For the purpose of the game the outer end of the line 122 will be provided with a "plug" 124 of special design for the purpose of the present invention. The plug 124 will be essentially conical in shape with an enlarged bulb 126 at the end thereof to provide suitable weight. The plug 124 is preferably made of resilient material such as rubber or plastic. The end of the plug 124 opposite from the bulb 126 connects with the line 122 and the shape of the plug permits reception thereof in the snare opening 98 For the purpose of catching a fish, such as game piece 90, the person playing the game or sport will cast the plug 124 into the opening between the loop 106 and the game board 20. It should be noted that the upper edges of the doors 42 and 44 are inclined toward the gap 50. At any event, when the person playing the game casts the plug 124 into the opening below the loop 106; the line 122 will pass downwardly through the gap 50 against one of the arms 70 and into the inclined opening 96 at the forward end of the fish 90. At this point the line will pass through the guide slot 100 into the snare opening 98. Pulling on the line 122 will cause the plug 124 to engage the snare opening 98 to pull a fish off the grommet 71.

Figure 10:
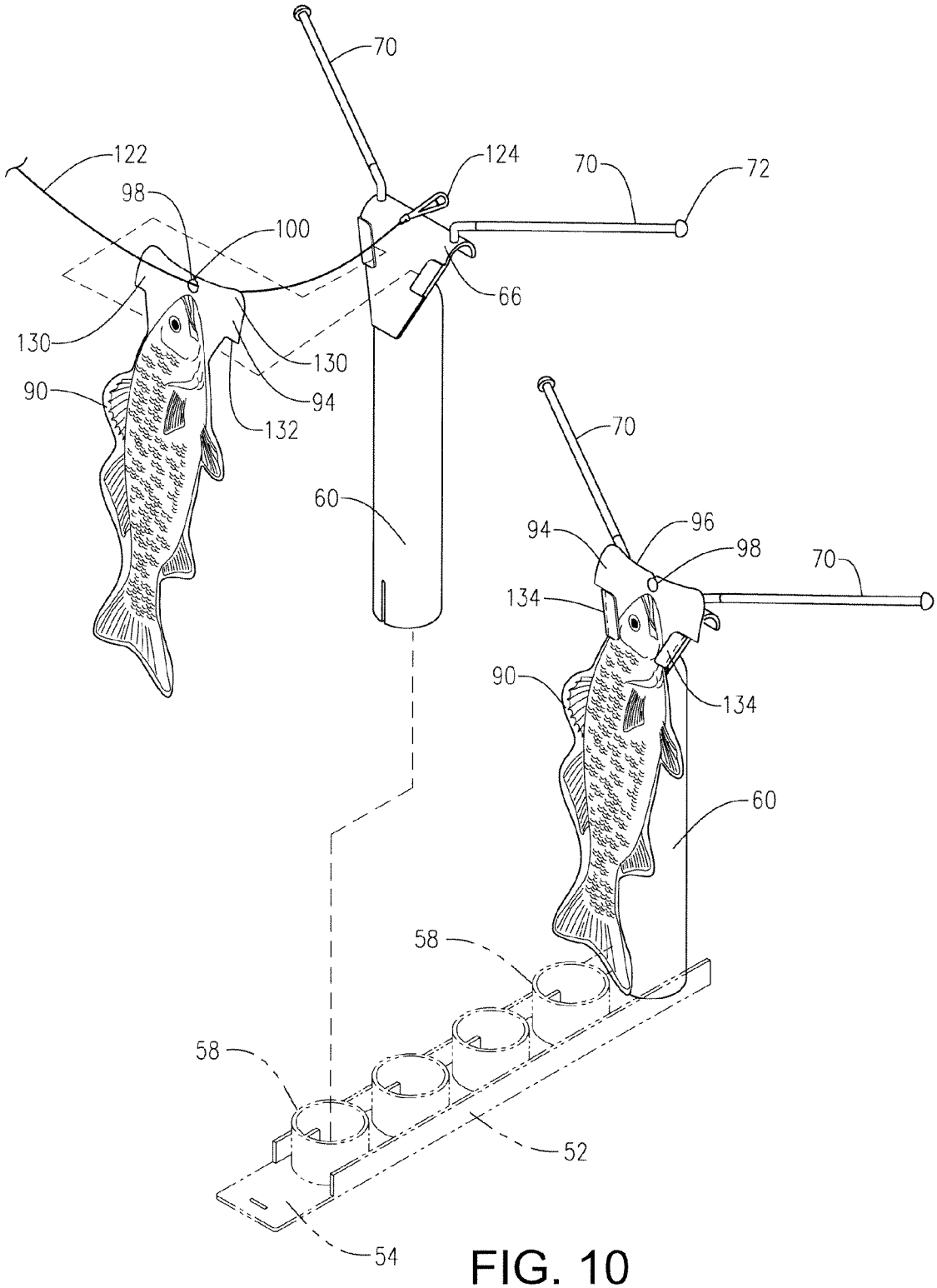
FIG. 10 is a view similar to FIG. 6 but showing an alternate embodiment of fish support.
Figure 11:
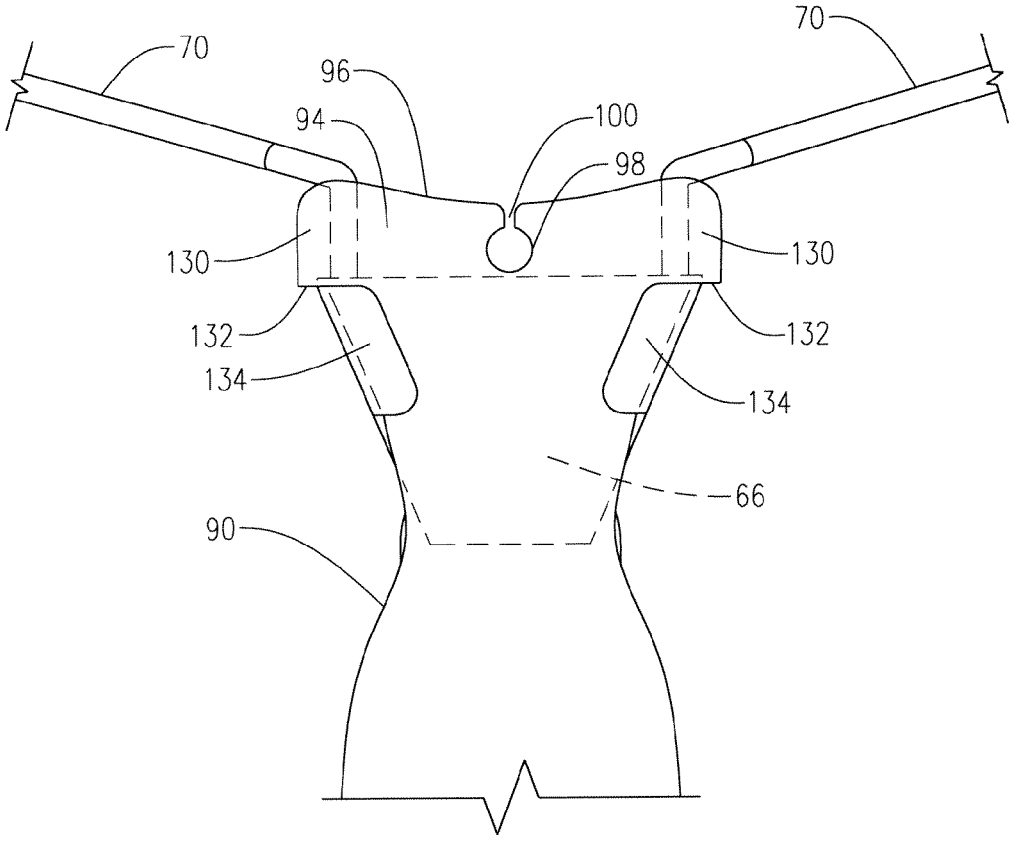
FIG. 11 is a detail, in elevation, of the fish and fish support shown in FIG. 10.

Turning now to FIG. 10, the game piece 90 (fish) still has the projecting portion 94 which includes the inclined entrance opening 96 which leads to a snare opening 98 (see now FIG. 11) through a guide slot 100. This compares with what has previously been shown in FIGS. 4 and 6. The support openings 102 have been eliminated and the corresponding grommets 71 are not employed. Instead, the projecting portion 94 is provided with a pair of opposite sideways projecting ears 130 below which are a pair of horizontal shoulders 132 which are adapted to rest against the upper ends of a pair of inclined clips or clamps 134. Clips 134 are secured to the sides of the triangular plate 66 and are disposed at an angle along the sides of the triangular plate 66 to provide a slot or slots for the fish 90 to be received therein. For this purpose the sides of the fish 90 below the shoulders 132 are shaped in a form of a diverging or converging slope 136.

Figure 12:
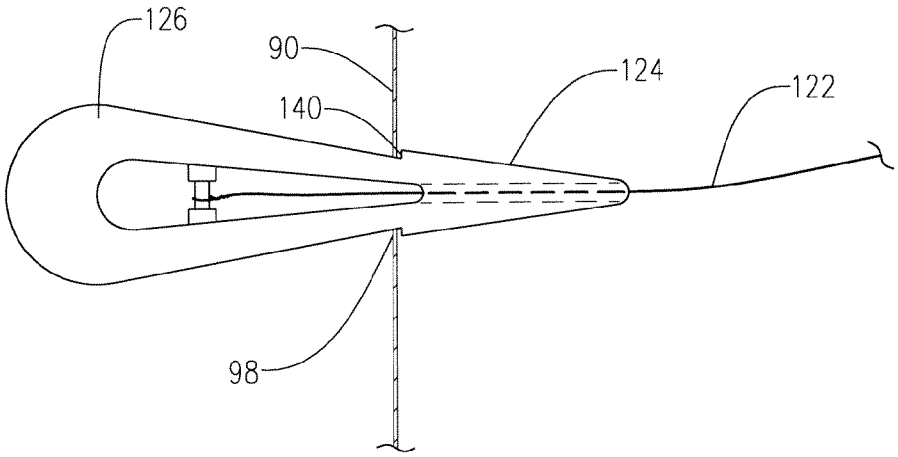
FIG. 12 is a view, partly in section, showing details of the plug that is used in snaring the fish.

FIG. 12 shows the plug 124 in slightly greater detail than previously disclosed. That is, when the line 122 passes through the guide slot 100 in the fish 90 and the line 122 is pulled so that the plug 124 enters the snare opening 98. The plug is also provided with a recess or shoulder 140 which prevents the plug from being disengaged from the fish 90.

Figure 13:
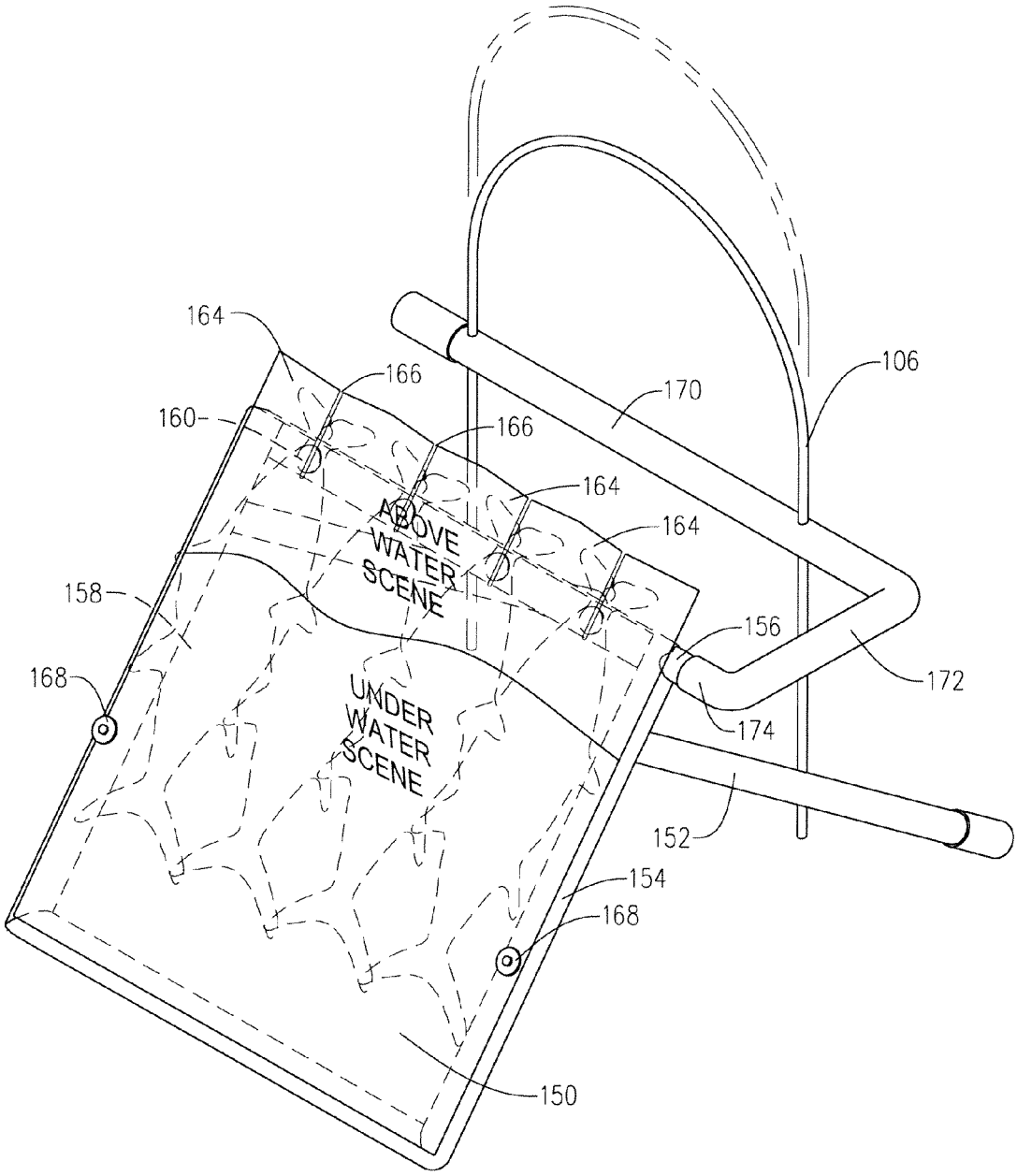
FIG. 13 is a view similar to FIG. 1 showing a modified form of the game board including the cast over back bar and optional target loop.
Figure 14:
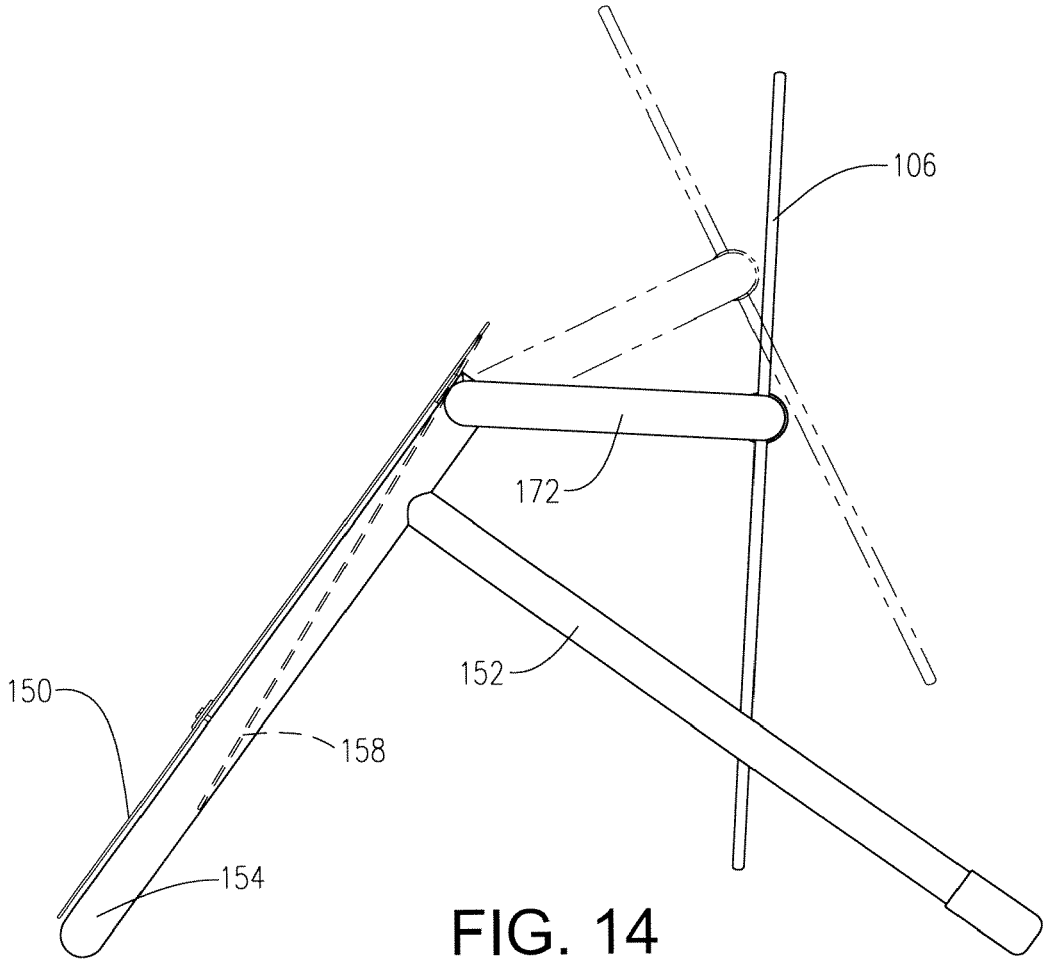
FIG. 14 is a side elevation of the elements shown in FIG. 13 with the loop adjustment being shown in an alternate position by dotted lines.

FIG. 13 shows a relatively flat game surface or board 150 which is disposed at a relatively large angle (preferably 45 degrees or more) with respect to the flat surface upon which the game board is mounted. The game board 150, more particularly, is provided with a pair of legs 152 which connect to a frame structure 154 to which the game board 150 is attached. The upper portion of the frame 154 for the game board 150 is provided with a horizontal tube or pipe 156 upon which a plurality of fish 158 can be mounted behind and parallel to the game board 150. Preferably the horizontal support is provided with a plurality of pieces of VELCRO 160 which mate with similar pieces of VELCRO 162 on the fish 158. Each fish 158 is also provided with a snare opening 98 previously described.

The game board 150 in FIG. 13 is provided with a plurality of vertical doors which are separated by vertical gaps 166 and which are mounted for swinging movement along horizontal axes beneath the bottom ends of the gaps 166. The game board 150 is also secured to the frame structure 154 by means of screws 168.

Figure 15:
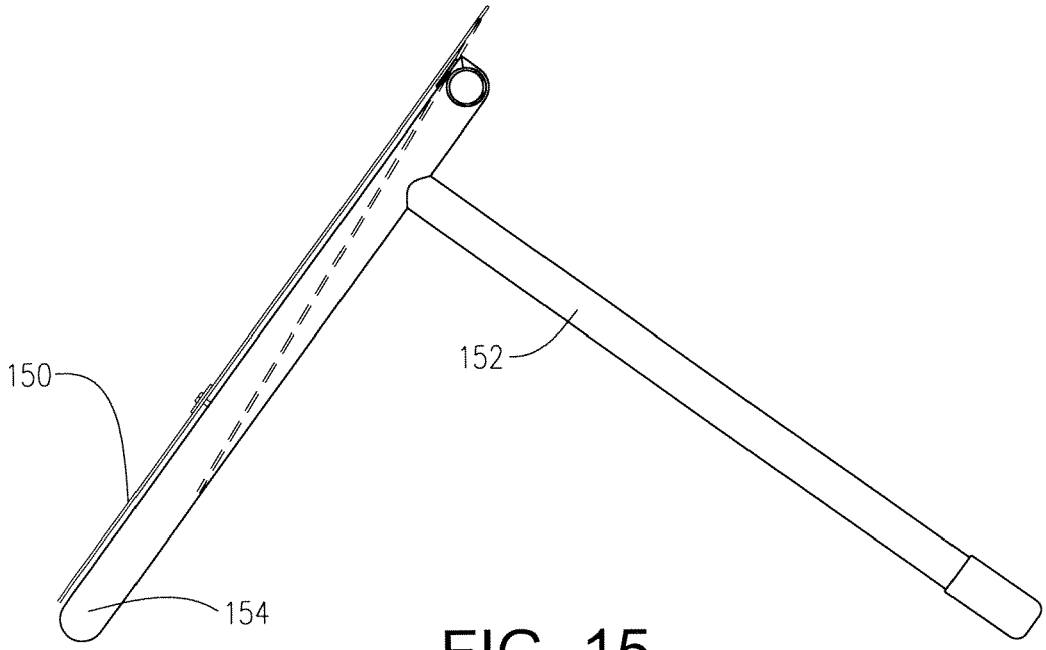
FIG. 15 is a view similar to FIG. 14 but with the cast over back bar and the optional target loop being removed.

In the embodiment shown in FIG. 13, the target loop 106 is slidably received in a pair of holes in an optional horizontal pipe or back bar 170 which connects at one end to a short pipe 172, at the end of which is a right angled connection 174. The right angle connection 174 connects over the end of the horizontal pipe 154 and is removable as shown in FIG. 15.

Figure 9:
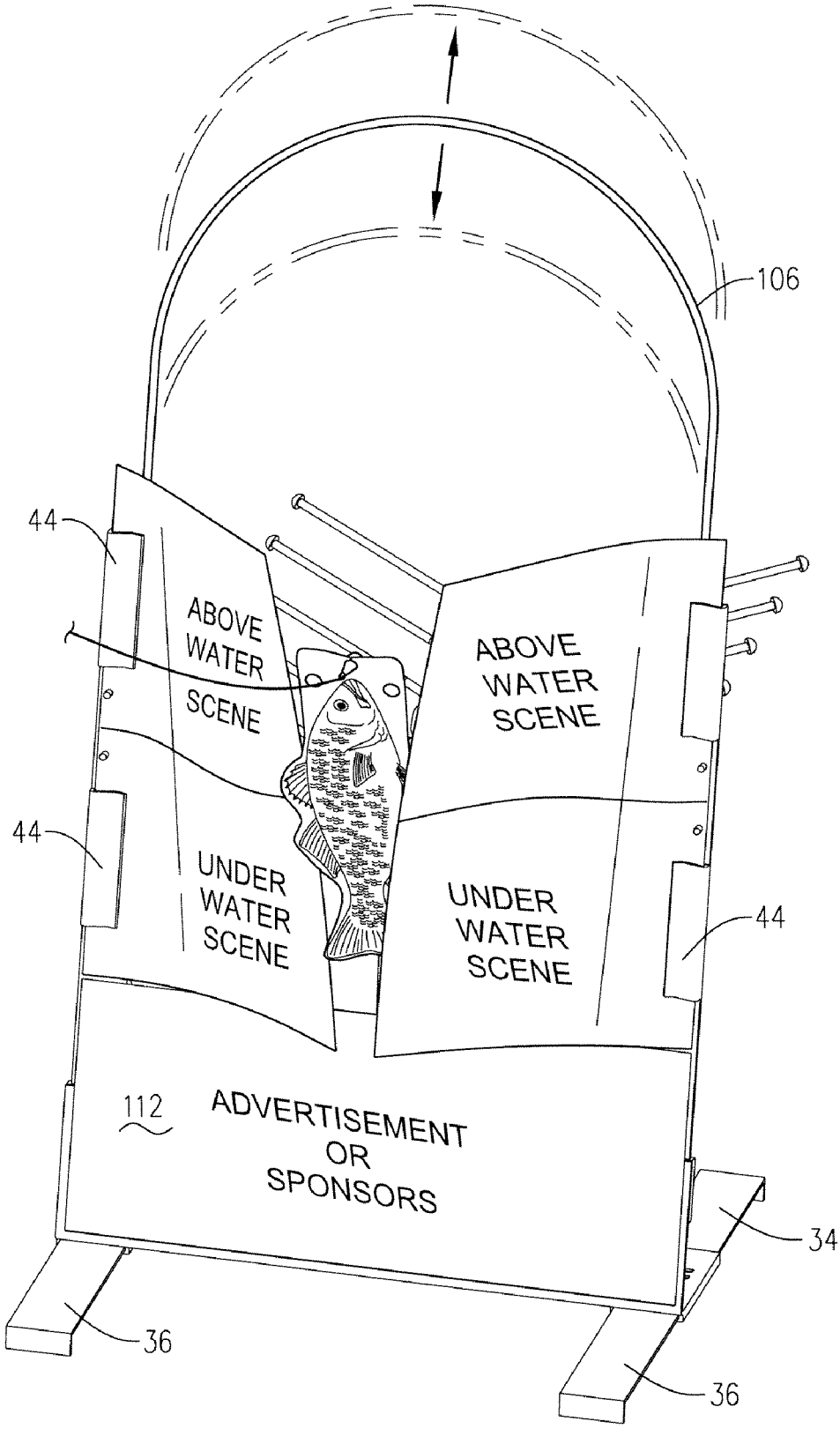
FIG. 9 is a front perspective view similar to FIG. 1 but showing the "catching" of a fish and the pulling of the fish through the doors.
Figure 16:
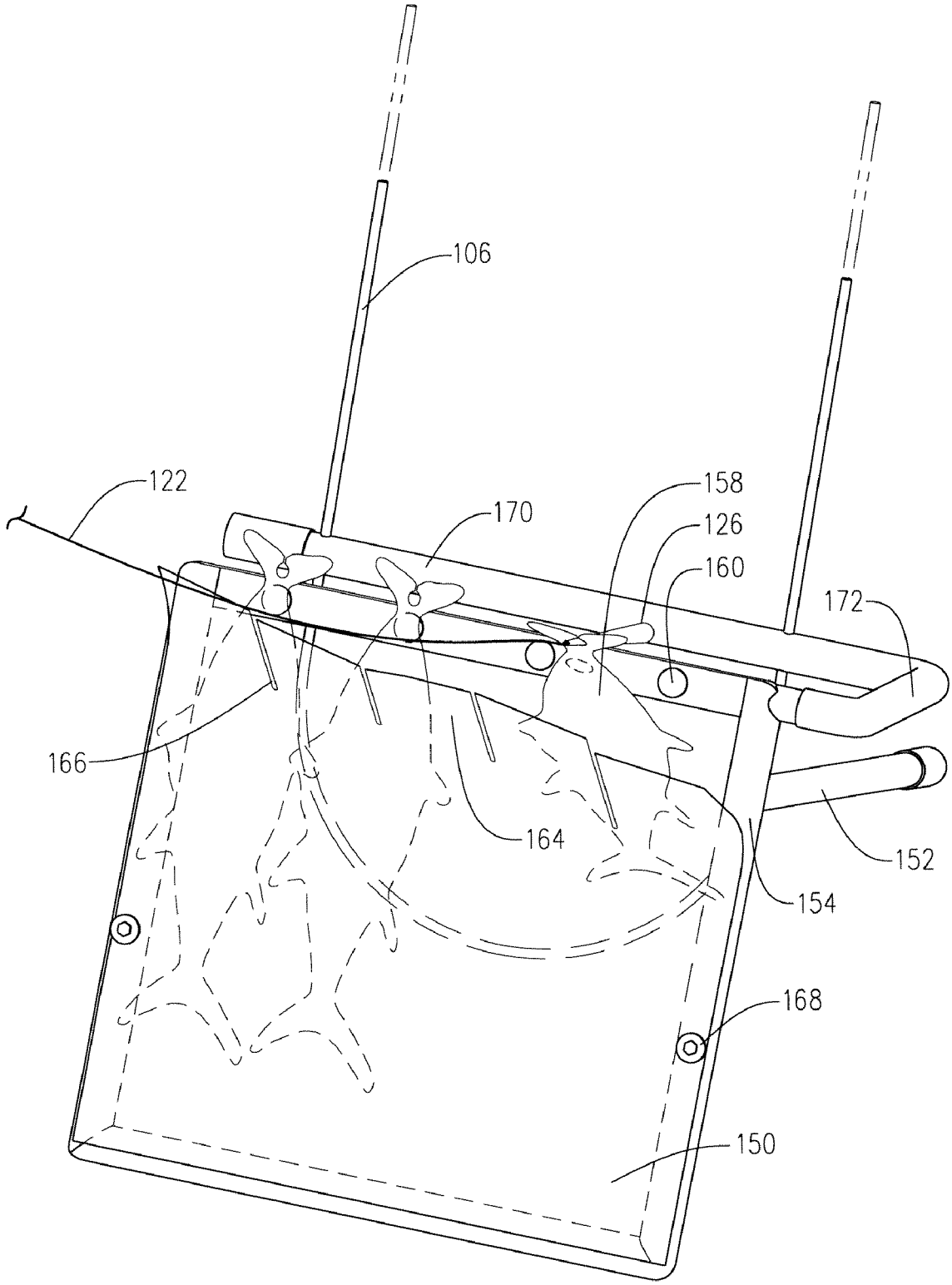
FIG. 16 is a view broadly similar to FIG. 13 but showing the catching of a fish through one of the vertical doors with the target loop being inverted.
Figure 17:
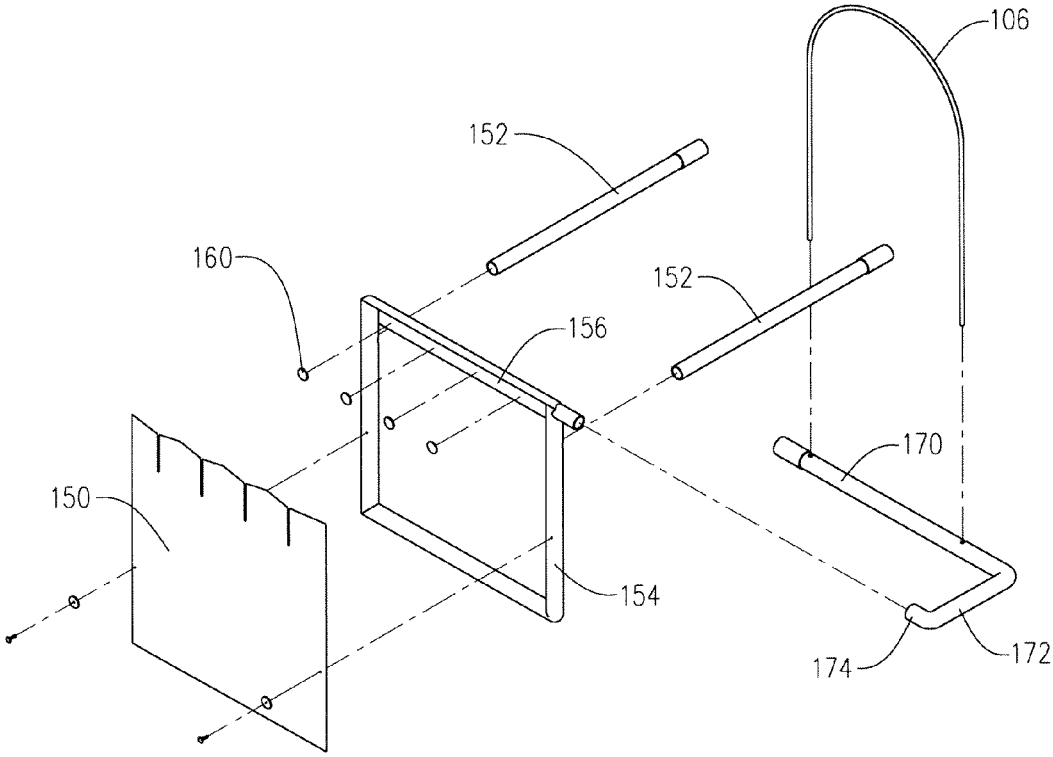
FIG. 17 is an exploded view showing the assembly of the device shown in FIG. 13.

FIG. 16 shows the manner in which a fish 158 is caught, similar to the prior description of catching a fish in relation to FIGS. 6 and 9. The end of the plug 124 opposite from the bulb 126 connects with the line 122 and the shape of the plug permits reception thereof into the snare opening 98 in the fish 158. The person playing the game will cast the plug 124 over the optional back bar 170 and between the twin uprights of the target loop 106. The line 122 passes downwardly through the gap 166, and thence downwardly through the guide slot 100 into the snare opening 98. Thereafter, pulling on the line 122 will cause the plug in the snare opening 98 to pull the fish off the VELCRO attachments 160 and 162.

Figure 19:
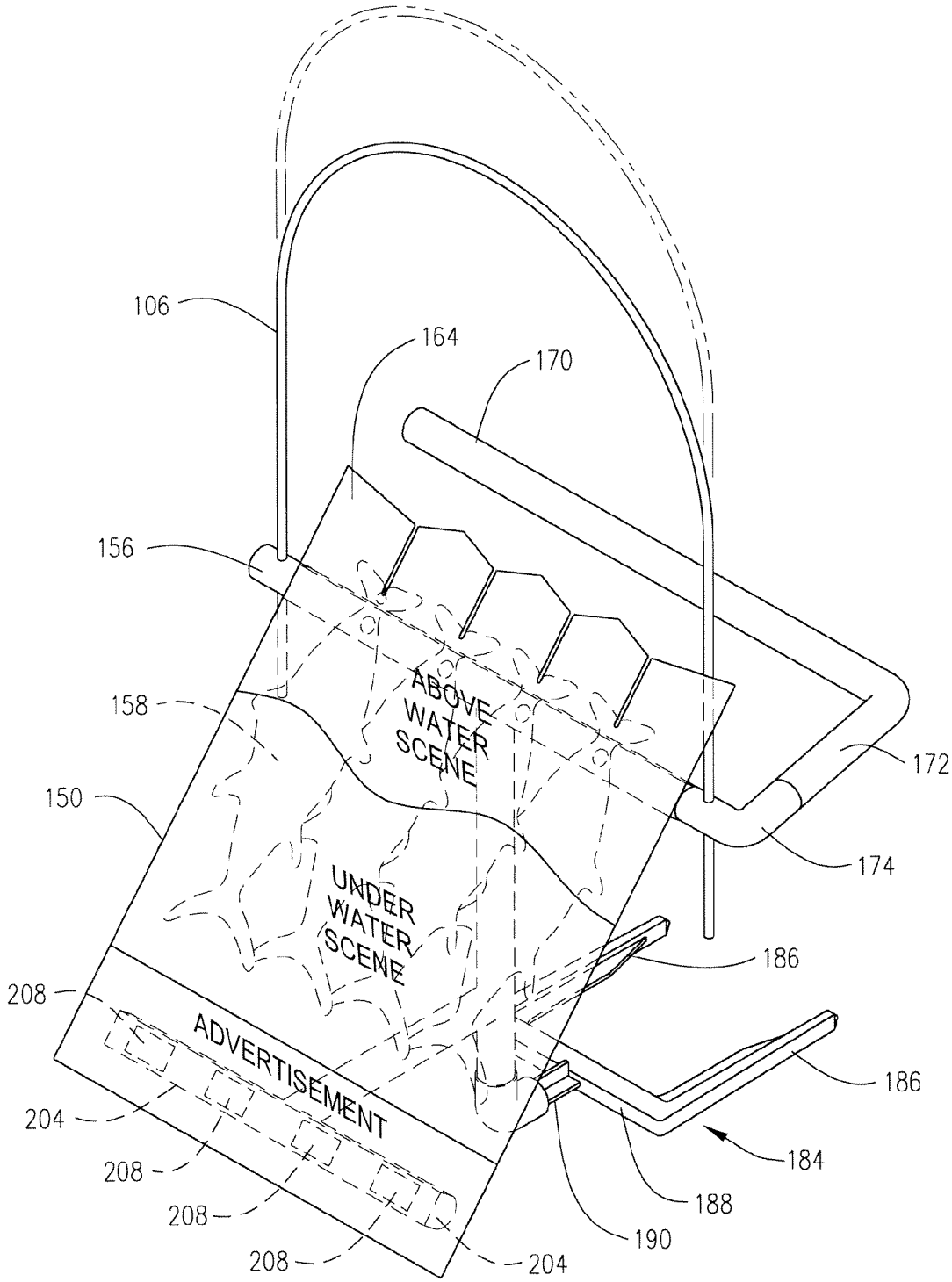
FIG. 19 is a perspective view similar to FIG. 13, the differences being in the bottom of the support structure and the manner in which the game board is attached to this supporting structure.
Figure 20:
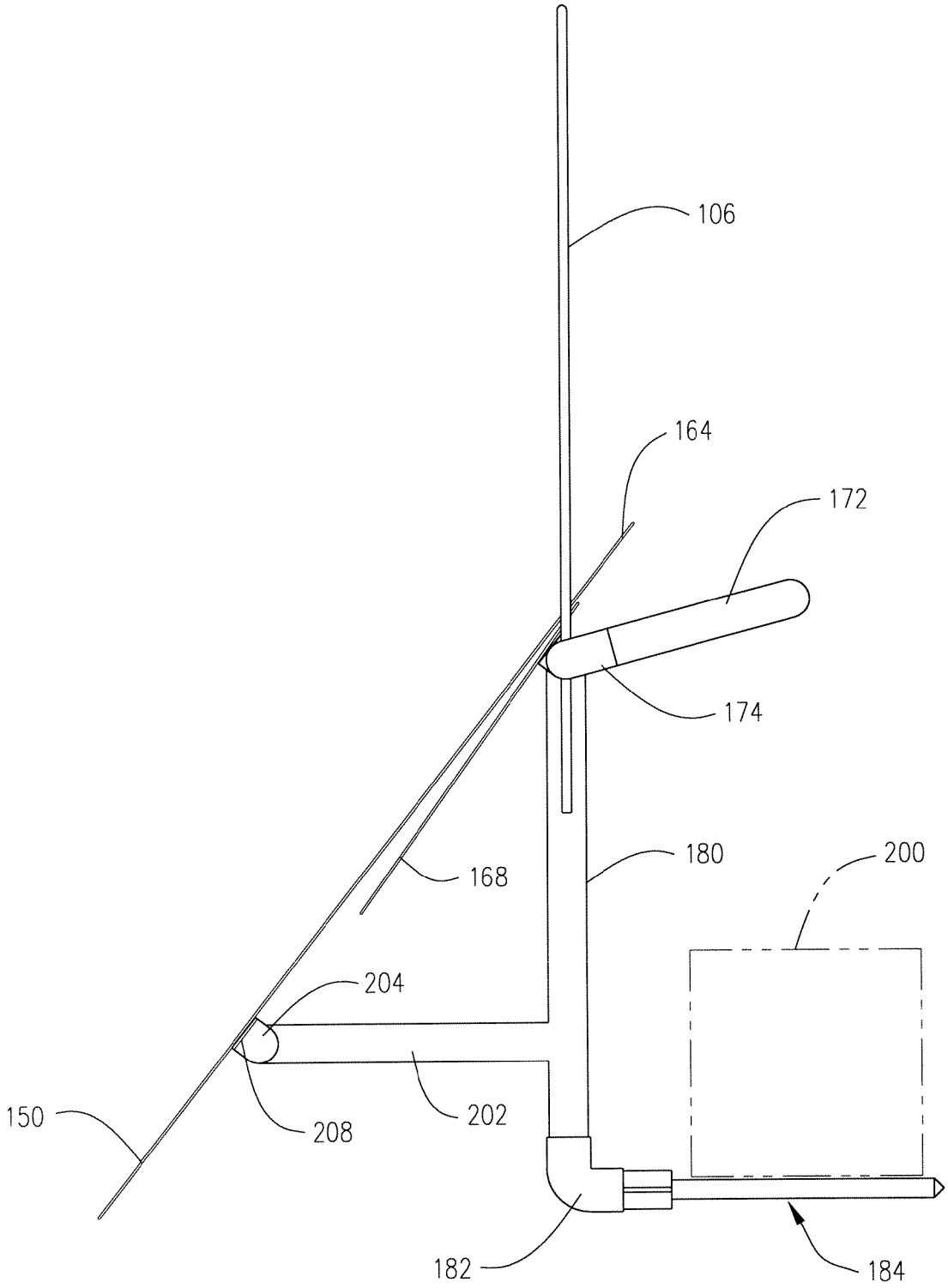
FIG. 20 is a right side elevation taken from FIG. 19.

In FIG. 19 (as is also shown in FIG. 20) the main structural member for supporting the game is a central vertical pipe 180 which has an upper end connecting mid-way with the horizontal pipe 156 (fish support). The lower end of the pipe 180 connects, in one modification, with an elbow 182 which in turn connects with a horizontal yoke 184. The yoke 184 is comprised of a pair of horizontally extending prongs 186. A horizontal top member 188 connects the two arms 186 in parallel relation and a central connector 190 is mounted on the arm 188 to be received in the lower horizontal opening in the elbow 182.

In the position shown in FIGS. 19 and 20, the arms 186 of the yoke 184 are horizontal; it is intended that the horizontal position of the yoke will permit the game to be supported in an essentially vertical position. In order to stabilize the vertical disposition of FIGS. 19 through 21 a weight 200 can be laid across the prongs 186.

Figure 18:
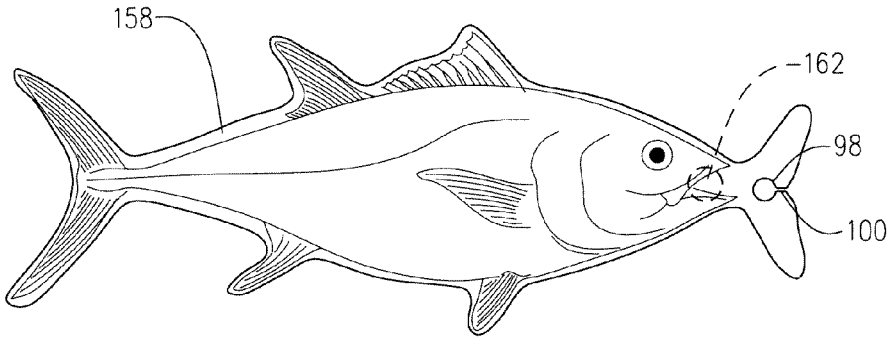
FIG. 18 is a view of a "fish" which can be used in the game of the present invention.

In order to support the game board 150 from the structure, a horizontal connecting pipe 202 extends forward (to the left as it appears in FIG. 20) from the lower central portion of the vertical supporting pipe 180 and at right angles thereto. The left-hand end of the connecting pipe 202 connects at right angles with a horizontal supporting pipe 204 which is forward and below the fish supporting horizontal member 156 but parallel thereto. The horizontal supporting pipe 204 has an inclined flat surface 206 which extends for the length of pipe 204 and which mates against the back side of the game board 150. This inclined surface is provided with strips of VELCRO 208 which hold the game board 150 in place. The upper portion of the game board 150 will rest against the side of the horizontal member 156 and the fish 168 will rest between this horizontal pipe 156 and the game board. As indicated in connection with FIG. 18, the fish are provided with VELCRO pieces or strips 160 which mate with pieces of VELCRO 208 arranged along the inclined side edge 206 of the horizontal pipe 204.

Figure 21:
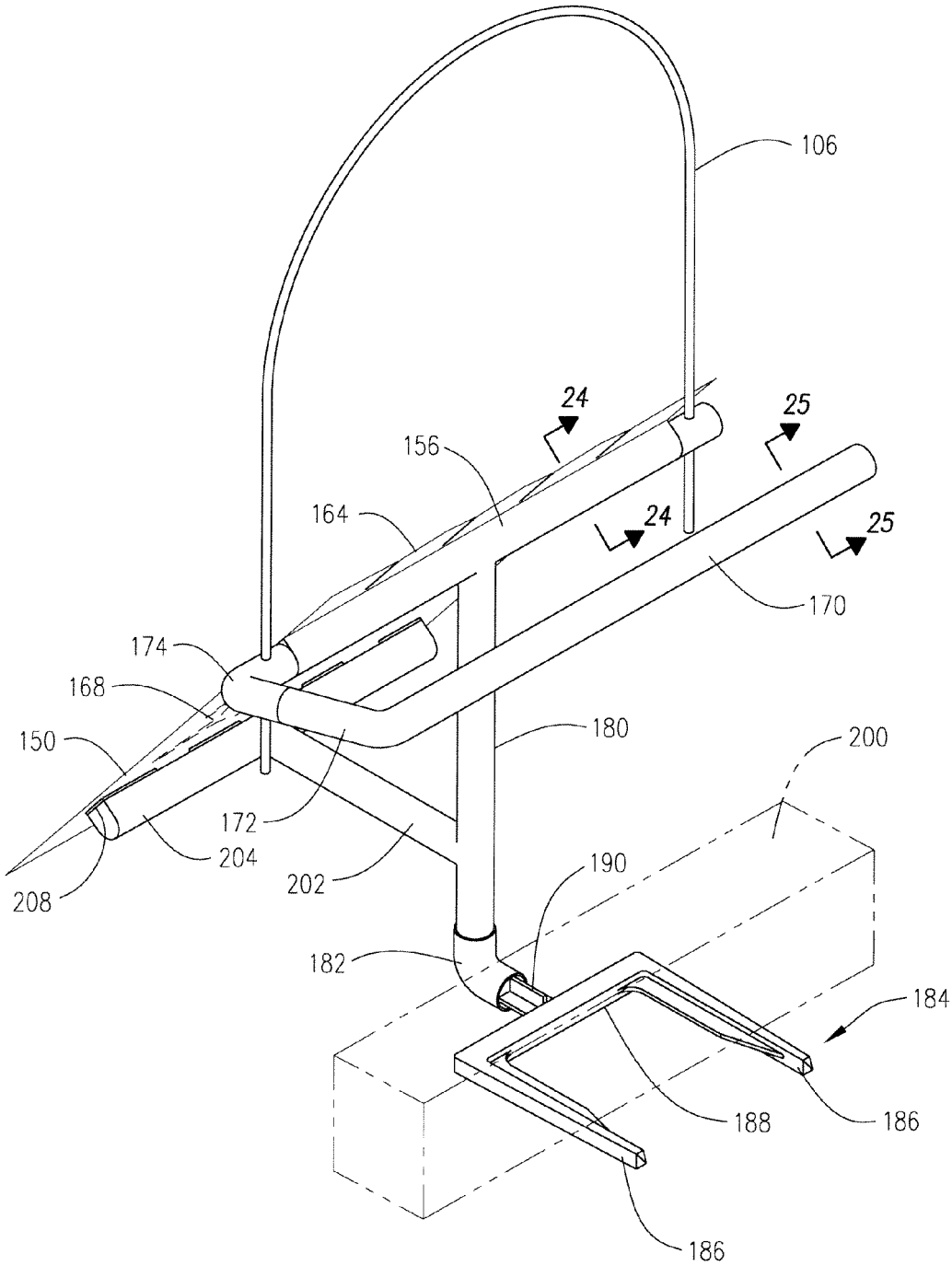
FIG. 21 is a rear perspective of the invention shown in FIG. 19.
Figure 22:
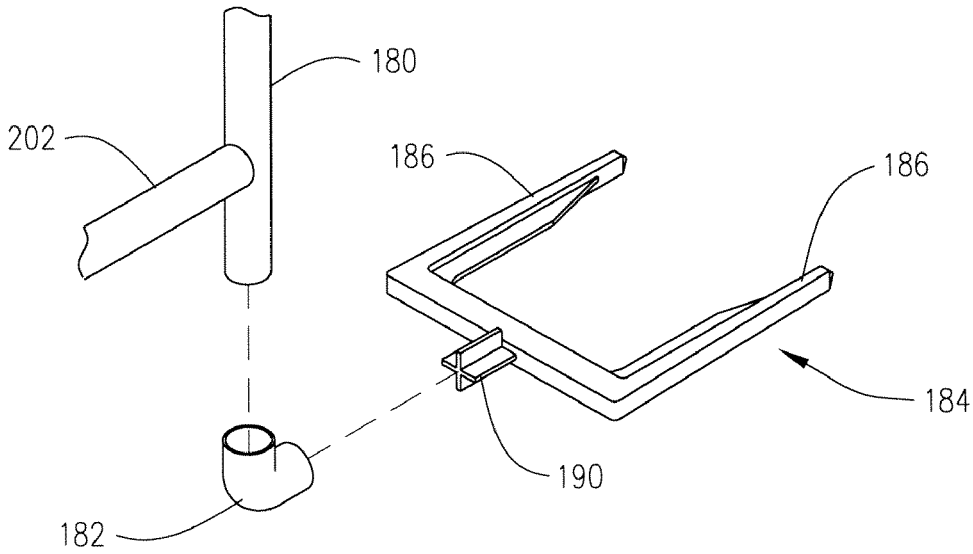
FIG. 22 is an exploded and fragmentary perspective view of the structure at the bottom of the supporting structure shown in FIG. 19.
Figure 23:
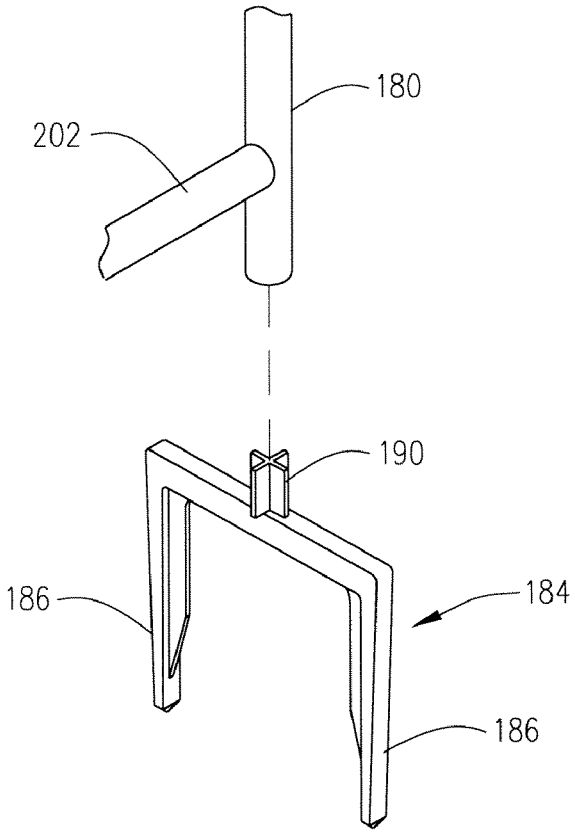
FIG. 23 is a view similar to FIG. 22 but showing the bottommost portion of the supporting structure for the game arranged for impaling into the ground.
Figure 24:
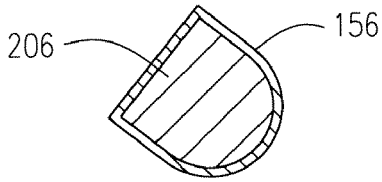
FIG. 24 is a cross-section through the horizontal member shown in FIGS. 19 through 21 for supporting the lower portion of the game board.

Referring now to FIG. 22, this represents an exploded fragmentary view of the bottom of FIGS. 20 and 21 and shows the vertical pipe 180 connecting with the elbow 182 which, in turn, connects with the yoke 184 through the connector 190. This represents the position also shown in FIGS. 19 and 20 where the weight 200 is used to hold the game in a vertical position. If the game is being played in an area where there is grass, the elbow 182 is eliminated and the yoke 184 is connected to the lower end of the vertical pipe 180 through the connector 190. In this arrangement, as shown in FIG. 23, the game can be placed in a vertical position by impaling the prongs 186 into the ground (not shown).

Figure 25:
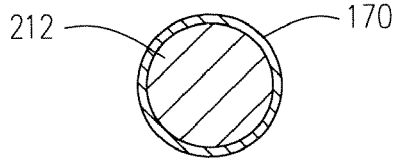
FIG. 25 is a cross-sectional view through the back bar showing that it is filled with foam to make the frame floatable.
Figure 26:
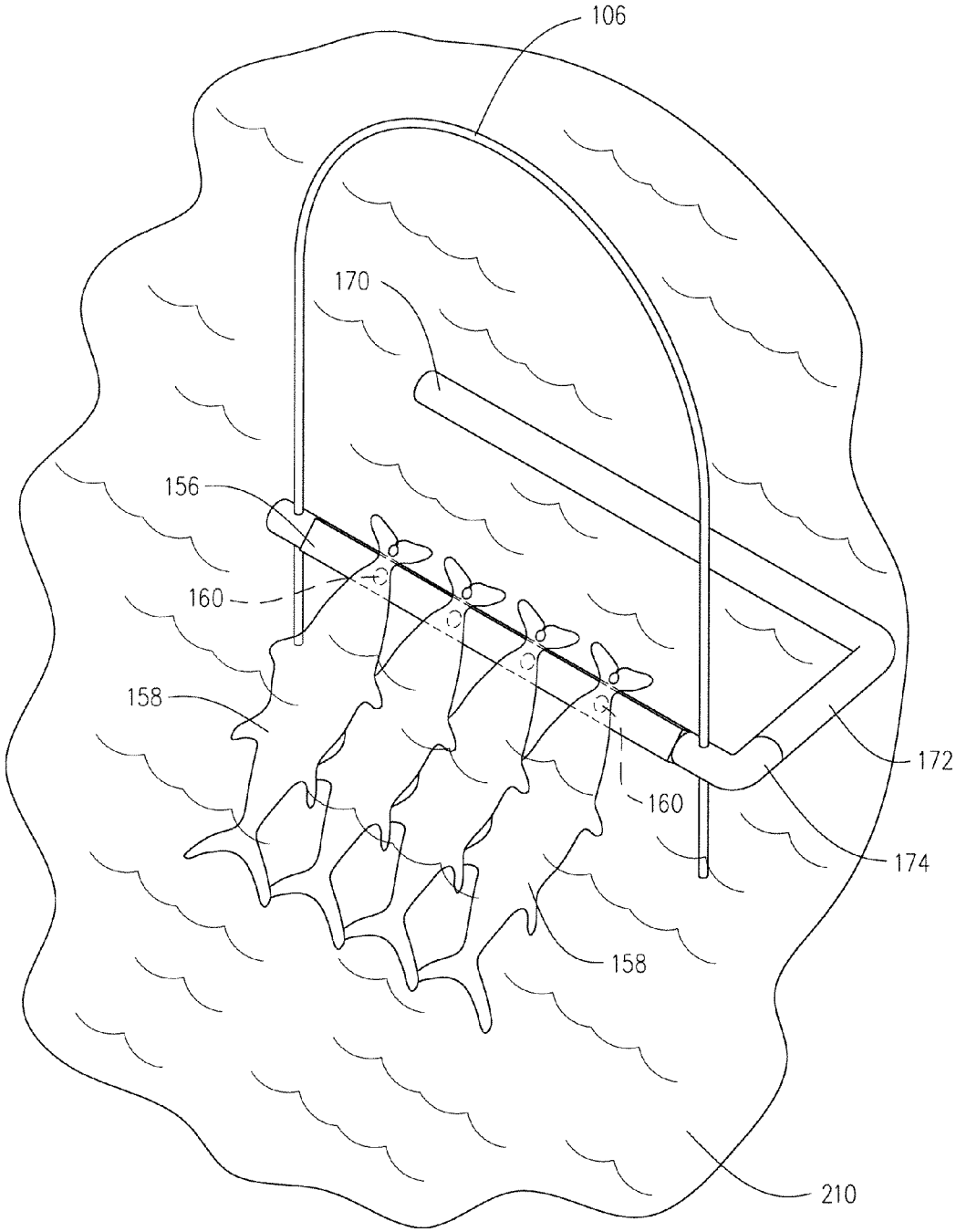
FIG. 26 is a view similar to FIG. 19 but showing the support and fish in water without the game board and without the lower structure for the support of the game.

Referring now to FIG. 26, the upper portion of the supporting structure for the game is shown as floating on water 210. In order to make the device floatable (buoyant), however, the optional back bar 170 is filled with a foam material 212 as shown in FIG. 25. The front pipe 156 is also filled with foam material so that the "game" as floating in the water consists primarily of horizontal pipes 156 and 170 with the fish 168 being supported on the bar 156 by means of the VELCRO strips 160, previously described. Alternatively, and preferably, the pipes 156 and 170 are foam molded by any of the several foam molding processes provided in the marketplace. Under the circumstances, since the game is already in the water, the game board 150 with the wallpaper thereon can be eliminated for the purposes of FIG. 26.

Figure 27:
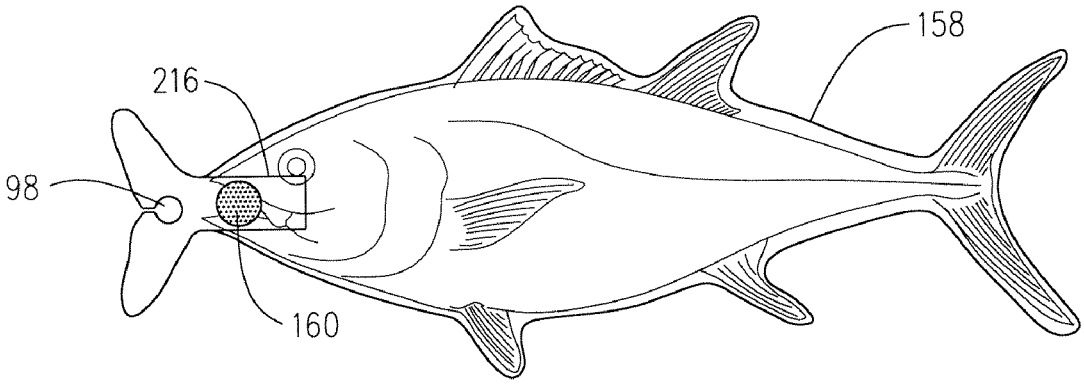
FIG. 27 is a view of a fish similar to that shown in FIG. 18 but showing the opposite side of the fish associated with a removable mouth piece.
Figure 28:
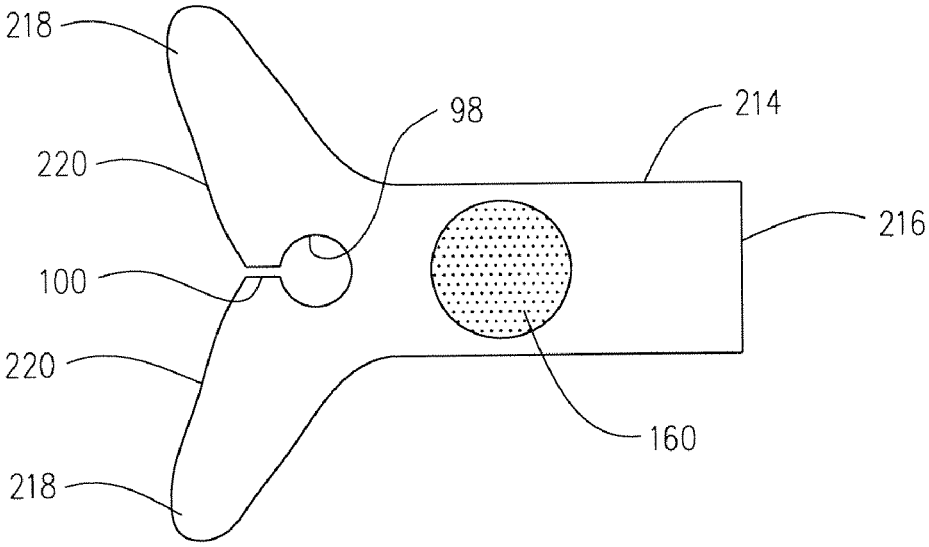
FIG. 28 is a perspective of the removable mouth piece shown in FIG. 27.

FIGS. 27 and 28 show an alternative embodiment for the snare opening 98.

Referring back to FIG. 18, the fish 158 is coated with clear plastic material and the forward right-hand end thereof is provided with the snare opening 98 which connects with the mouth of the piece through a slot 100. It is contemplated for the purposes of FIGS. 27 and 28 that the forward piece which includes the snare opening 98 and the connecting slot 100 will be a separate piece. Thus, in FIG. 27 which is the reverse side of the fish shown in FIG. 18, the snare opening 98 is located in a removable plastic mouth piece 214 which is somewhat Y-shaped. The removable mouth piece 214 has a horizontally extending portion or tab 216 which is adapted to overly the forward end of the fish as shown in FIG. 27. The left-hand end of the removable mouth piece 216 is provided with a pair of diverging arms or wings 218 which are provided with inclined edges 220 for the purpose of assisting the line in reaching the snare opening 98.

When casting for fish using the arrangement shown in FIGS. 19 through 22, the fisherman playing the game will cast his plug through the opening provided by the loop 106 and over the optional back bar 170. The user will then pull on the line and draw the plug over the back bar 170 until it crosses over the same while at the same time maneuvering the line into one of the slots between the vertical doors 164. When the line falls down the slot and the plug is engaged in the snare opening 98, pulling on the line thereafter will cause the fish 156 to be removed from the pipe 156 and one or more of the vertical doors 164 will pivot, as will indeed the entire game board 150, so that the fish 158 will be removed from the bar 156. After removal of the fish from the bar 156 the game board 150 will return to its position of rest against the bar 156.

Whereas the present invention has been described in particular relation to the drawings attached hereto, it should be understood that other and further modifications of the present invention, apart from those shown or suggested herein, may be made within the spirit and scope of this invention. No particular claim or significance should be attached to the materials employed in the various components of the invention. Purely for purposes of explanation and completeness, the fish 90 can be made from a thin plastic material such as 020" PVC/Vinyl. Fish graphics can be applied to one or both sides of the fish by decal or screen printing. The plug 124 can be made by injection molding using a soft rubber or plastic material.

The tubing 106 can be polyethylene tubing, for example. The tubing and other structural elements shown in FIGS. 19 to 26, especially the fish support 156 and the optional back bar 170, are preferably made by foam molding because the game must be capable of floating as shown in FIG. 26. A suitable place to have the foam molding done is Taylor Foam of Oklahoma City, Okla.

The game board 20 and base member 22 can be made of ABC plastic ⅛" thick. The tubes 60 and associated connections can be made from PVC plastic tubing. The "wallpaper" 116 and the coverings for the various doors can be made from graphics decal sheets. The doors themselves can be made from PVC plastic sheets @0.020" thickness with graphics decals attached.

The fish can be attached to their supports by several different kinds of releasable holding means; for example the releasable holding means can be grommets, or clips or VELCRO® strips as shown herein. However, other releasable holding means could be employed such as magnets (not shown), adhesive (not shown), adhesive strips (not shown) or suction cups (not shown).

Figure 29:
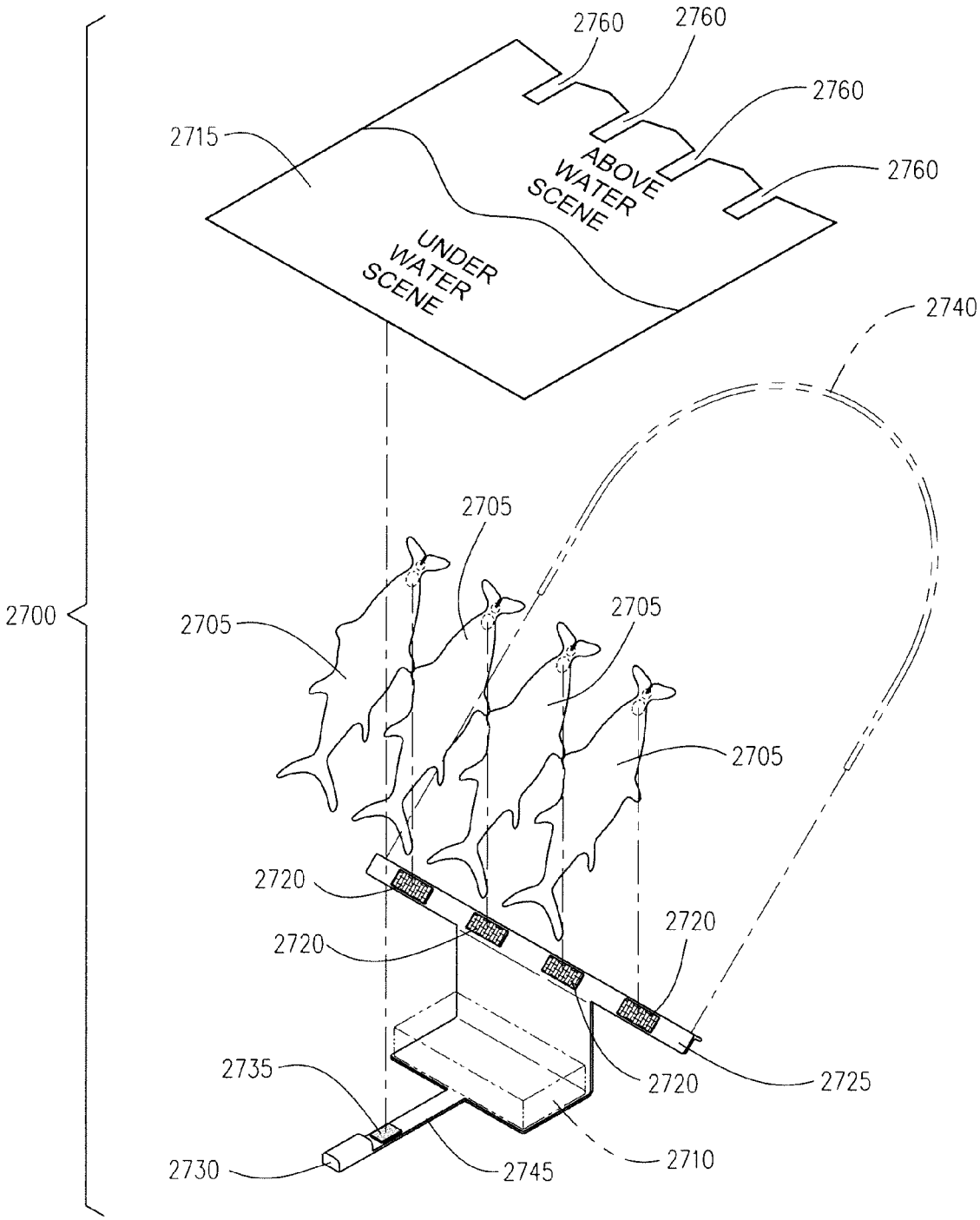
FIG. 29 is a view of another preferred embodiment, which utilizes hook and loop type materials to removably attach the game pieces to a support bar.

Finally, there is provided another embodiment substantially as described above, wherein a hook and loop material (e.g., VELCRO®) is used as a mechanism for engaging a game piece and pulling it toward the user when a successful catch has been made. In the preferred embodiment, the weighted plug that is cast by the user will urge a circular (or other shaped) patch of hook and loop material toward a corresponding piece of this material that has been placed on the rearward side of the game piece, thereby snagging it. FIG. 29 illustrates a preferred embodiment of this aspect of the invention.

Fishing game 2700 includes a plurality of preferably fish-shaped game pieces 2705 which are suspended from support bar 2725 through the use of pieces of hook and loop fabric 2720 that have been affixed to the rearward side thereof. Although it is preferred that each game piece 2705 have the general outline and shape of a fish, that is not strictly required. The instant invention would operate similarly if the game piece were, for example, rectangular in shape with a proportionally sized image of a fish printed thereon. Additionally, although printing the image of a fish on the surface of the game piece 2705 is certainly one preferred way of placing the image there, other technologies could alternatively be used (e.g., embedding an image of a fish in clear plastic, etc.) and those of ordinary skill in the art will be able to readily devise such.

Weight 2710 (e.g., a brick or similar dense and heavy item) is positioned on the base of the game stand and helps keep the support bar 2725 and target hoop 2740 in upright position while the game is played. Additionally, this embodiment is especially well-suited for use in shallow water, as the weight 2710 helps keeps the game 2700 firmly planted on the bottom of, e.g., a shallow swimming pool or in the shallows of a body of water. Of course, in other embodiments the brick 2710 might be replaced with a buoyant material such as STYROFOAM®. In that instance, the entire invention 2700 would tend to float on or near the surface of the water and, thus, would be suitable for use in water of any depth.

Stability bar 2745 is preferably provided and helps prevent the advance of the game 2700 toward the user when the fishing line with game piece 2705 attached is pulled toward the user and, when counterbalance weight 2730 is in place, prevents backward rotation of the instant invention when the optional target hoop 2740 is used. Game board 2715 is designed to be positioned between the gamer and the game piece 2705 so that at least a portion part of the fish body is obscured (e.g., all but the head) and, in some embodiments, will have one end resting against counterbalance weight 2730 and the other (i.e., the end with the gaps 2760) end positioned near the upper ends of the fish gaming pieces 2705. This aspect of the invention can be seen more clearly in FIG. 32.

Figure 30:
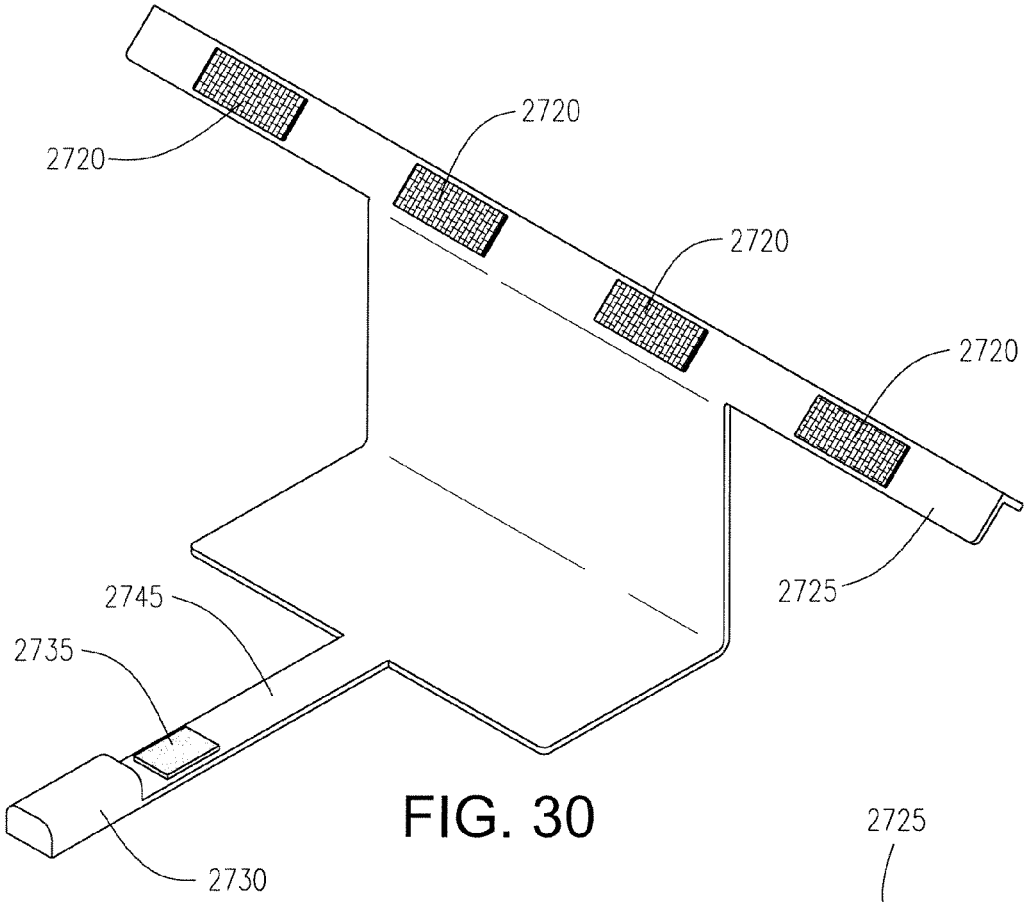
FIG. 30 is a close-up view of one aspect of the embodiment of FIG. 29.
Figure 31:
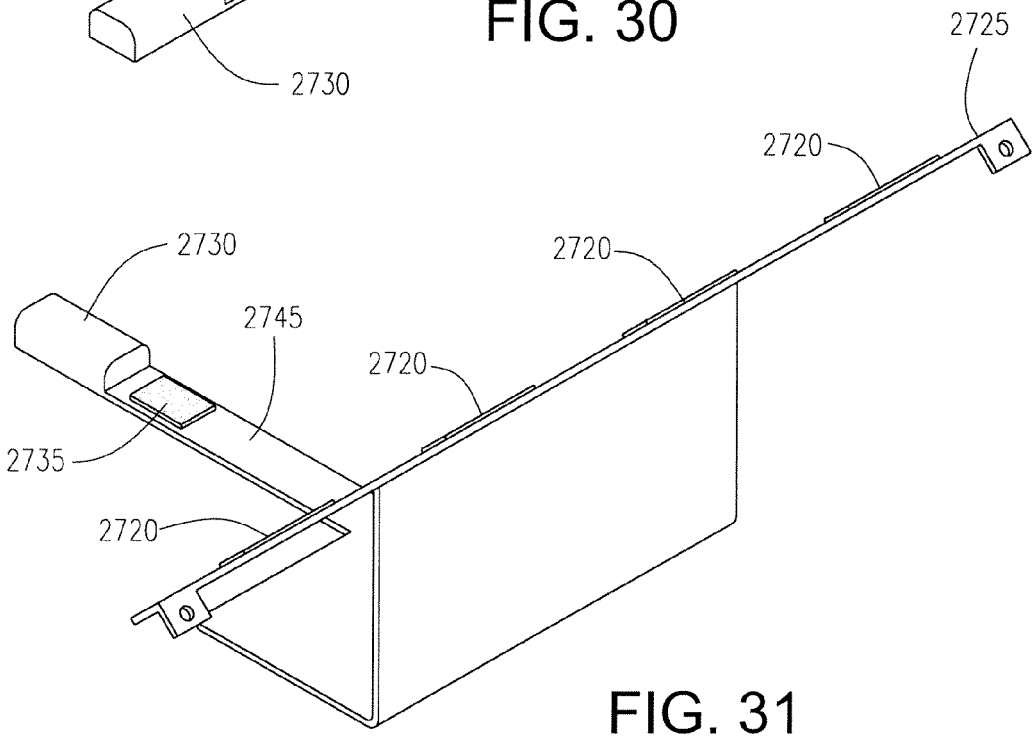
FIG. 31 is an alternative view of the embodiment FIG. 30.
Figure 35:
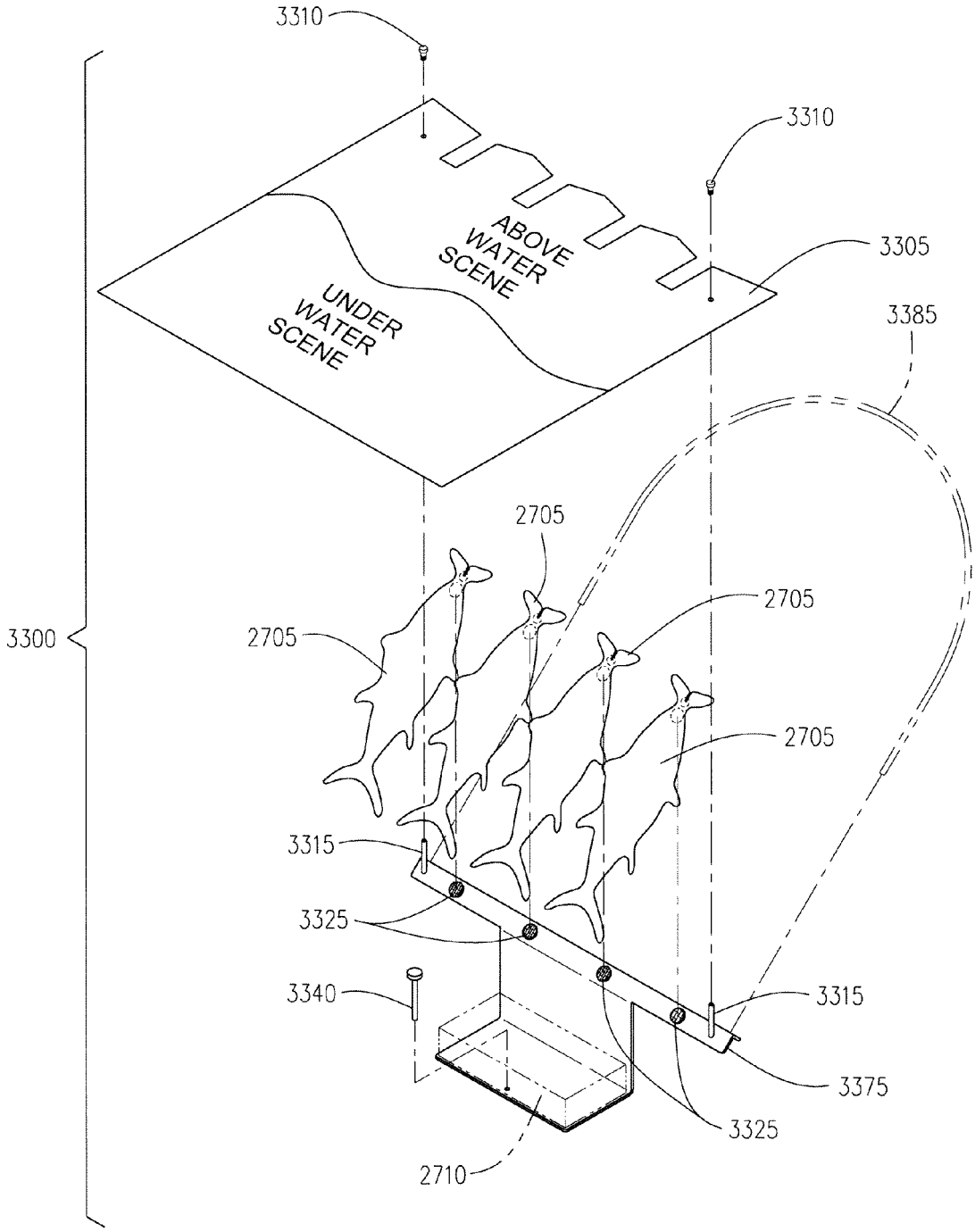
FIG. 35 illustrates another preferred embodiment which utilizes a game board on which a fishing-related scene is printed thereon.

FIGS. 30 and 31 illustrate in greater detail the base of the instant gaming embodiment 2700. In this embodiment, adhesive pad 2735 is placed on extension member 2745 in order to help secure the game board 2715 to the base of the game 2700 and keep it in place during game activity. In some preferred embodiments (e.g., FIG. 35), the game board 2715 might have a real or stylized image of an underwater view containing fish, plants, etc. In other embodiments, the image might be divided into an upper above water view and a lower underwater view. That being said, although a fishing motif that is printed on the game board 2700 would certainly be preferable there is no requirement that the image be fishing related.

Figure 32:
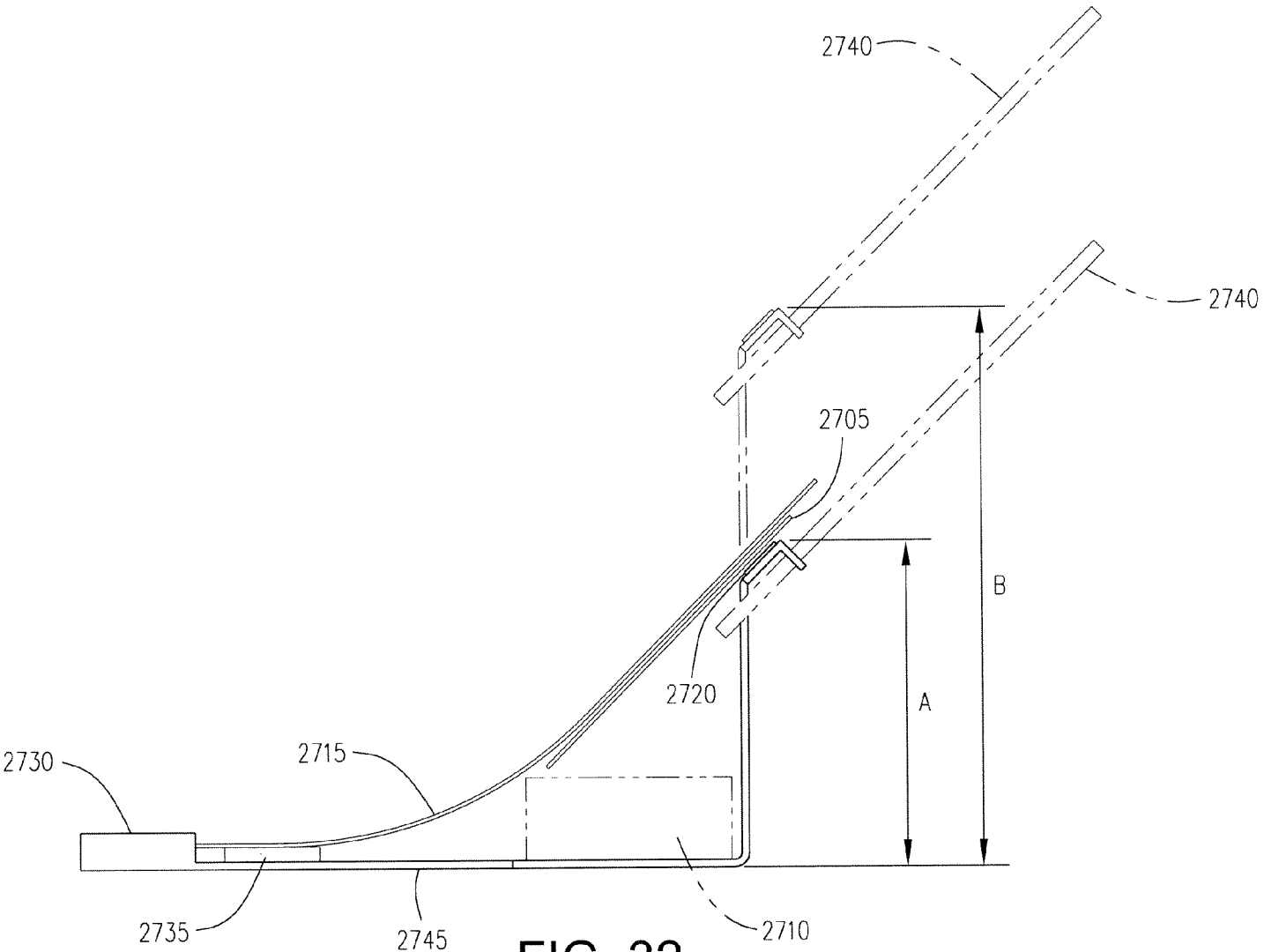
FIG. 32 is a side view of the embodiment of FIG. 29.

Turning next to FIG. 32, this figure illustrates how the instant game apparatus 2700 might appear with the game board 2715 in place. As can be seen in this figure, in a preferred arrangement, the game board will be positioned in such a manner as to largely obscure the fish game pieces 2705 which are suspended from the support bar 2725. Preferably, the line slot 3110 of each of the fish game pieces 2705 will be arranged to appear within one of the gaps 2760 in the game board 2715 when the unit is assembled and ready for operation. Thus, a participant will preferably be able to see only the upper extent (e.g., the mouth) of the game piece 2705 from the normal position during play. This helps assure that there will be some degree of surprise on the part of the participant when the game piece 2705 is retrieved using the plug apparatus discussed below.

Figure 33:
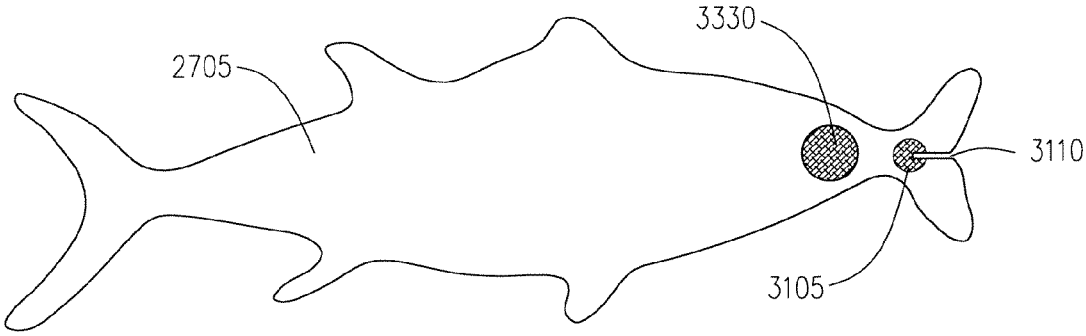
FIG. 33 is a detailed view of a preferred game piece which utilizes a hook and loop material as a way to engage the lure.
Figure 34:
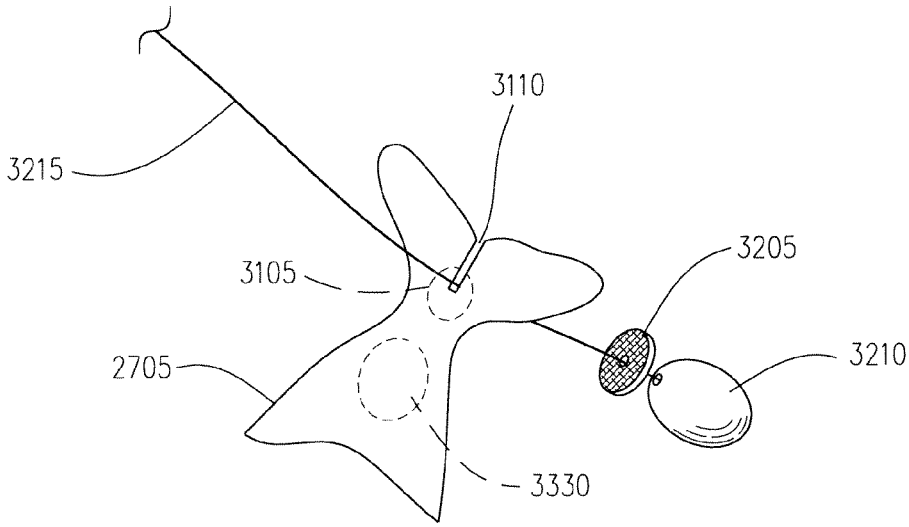
FIG. 34 is a detailed view of a preferred guide slot/plug combination suitable for use with the instant invention.

FIG. 33 illustrates the preferred embodiment of the fish game piece 2705. As is clear in this figure, in a preferred arrangement, the line slot 3110 extends from the upper end of the game piece 2705 and terminates within the body of the hook and loop fabric 3105. One reason for this preferred arrangement is illustrated in greater detail in FIG. 34. Preferably, a user will cast a plug 3210 (which might either float or sink) in the general direction of fishing game 2700 with the hope that the fishing line 3215 will be directed into the line slot 3110. If that happens, when the user retrieves the line 3215 into the fishing reel as is conventionally done, the line 3215 will pull plug 3210 and hook and loop element 3205 toward the game piece 2705 through which the line 3215 passes. At some point, the hook (or loop) material 3205 will come into contact with and removably mate with its corresponding element 3105 which is attached to the rearward face of the game piece 2705, thereby engaging the fish 2705 and allowing it to be retrieved back to the user. It is important to note that the material 3205 engages its corresponding element 3105 on the side of the game piece 2705 that is opposite from the user.

According to still another preferred embodiment, there is provided a fish gaming system 3300 which does not utilize an extension member 2745, but instead is kept vertical solely by weighting element 3325. The fish game pieces 2705 are outfitted with two hook and loop fabric sections (FIG. 33). The upper section 3105 is preferably designed to mate with a corresponding element 3205 which is urged toward the line slot 3110 by plug 3210 when the line 3215 is drawn back into the reel. The second hook and loop material section 3330 is positioned to mate with corresponding element 3325 which is found on the support bar 3375. As before, weighted element 2710 is preferably arranged to hold the game 3300 in an upright orientation in shallow water or to help float it, depending on whether the element 3325 is a brick or STYROFOAM®, etc.

Figure 36:
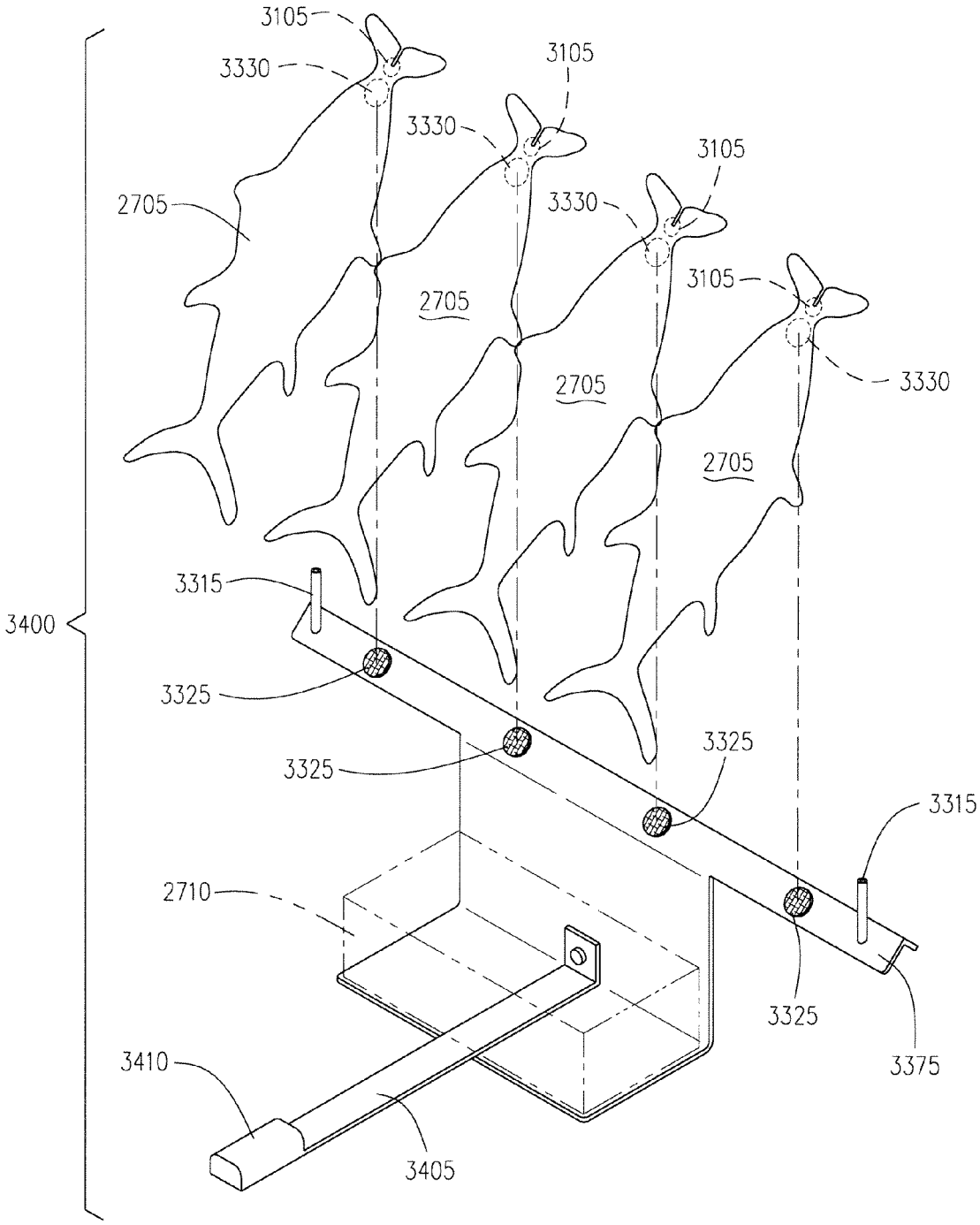
FIG. 36 contains an illustration of another preferred embodiment, wherein the hook and loop fasteners on the game piece and support bar are similarly sized.

In FIG. 36, the embodiment 3400 has stabilizing bar 3504 to increase the stability of the game 3400. Counterbalance weight 2710 will preferably be used to help maintain the game board 3305 in place when the game board is positioned on the support 3375. Note that, in some preferred embodiments, one or more bolts 3340 will be used to affix the weight 3325 to the base of the game 3330. Additionally, it is preferred that upright pins 3315 be provided to maintain some amount of separation between the game board 3305 and the support member 3375. This allows the fish 2705 to be withdrawn more readily when the user engages it.

Figure 37:
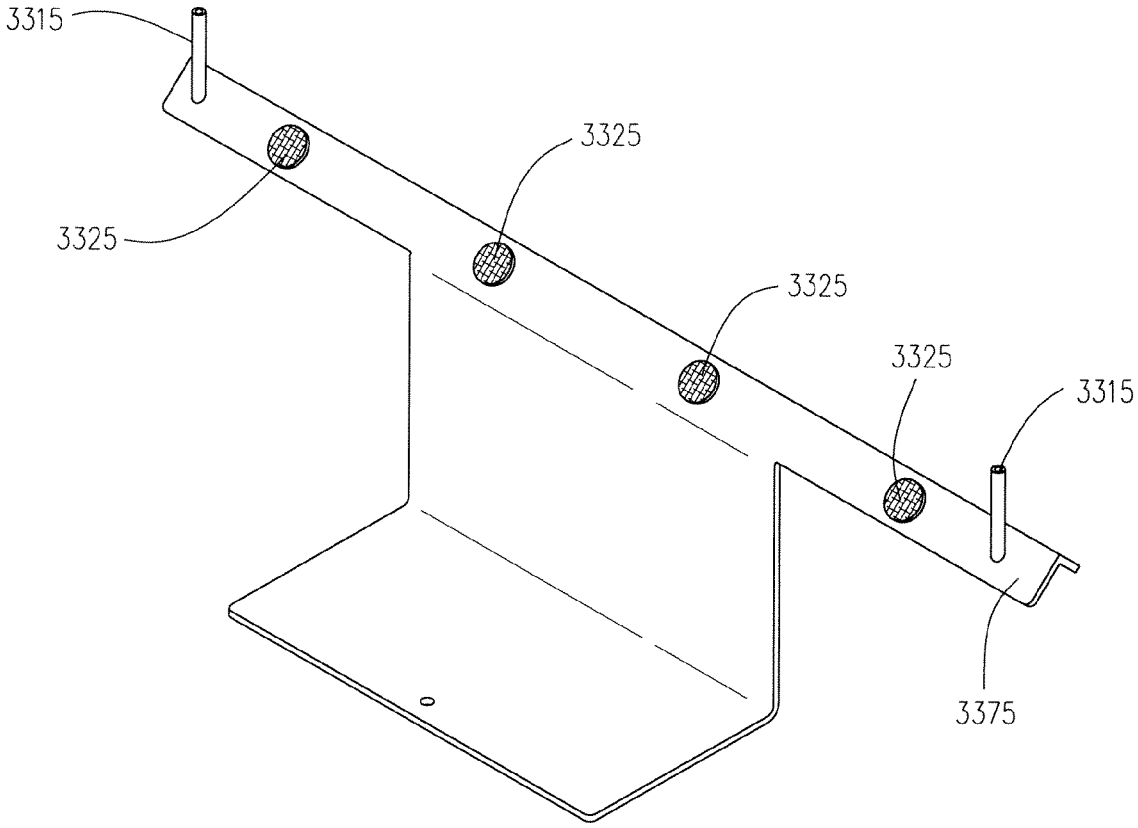
FIG. 37 contains a detailed view of a portion of the embodiment of FIG. 36.
Figure 38:
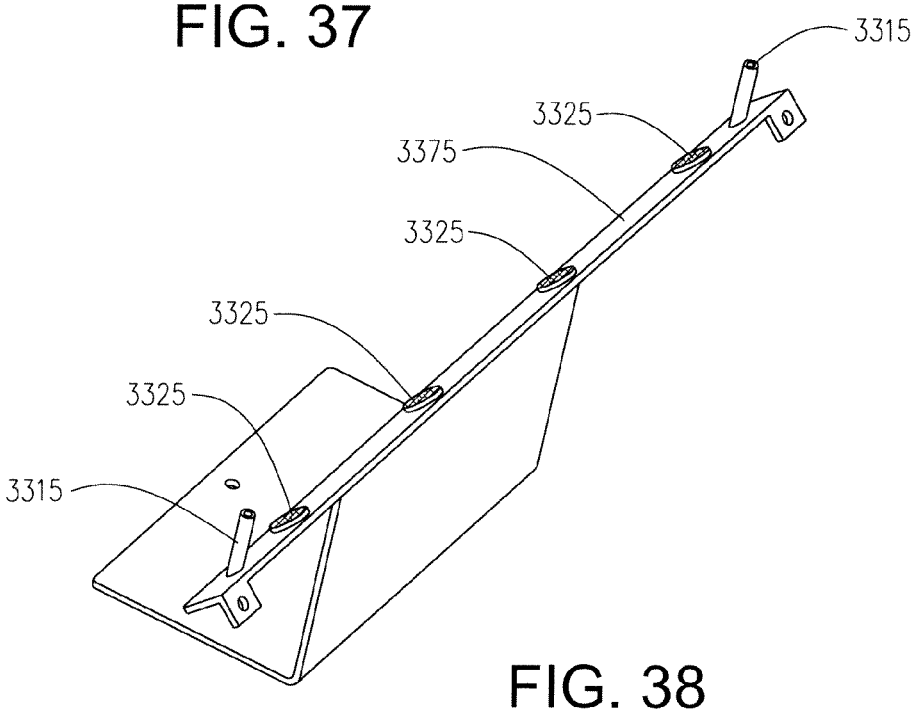
FIG. 38 illustrates the embodiment of FIG. 36 as it would appear from a different viewpoint.
Figure 39:
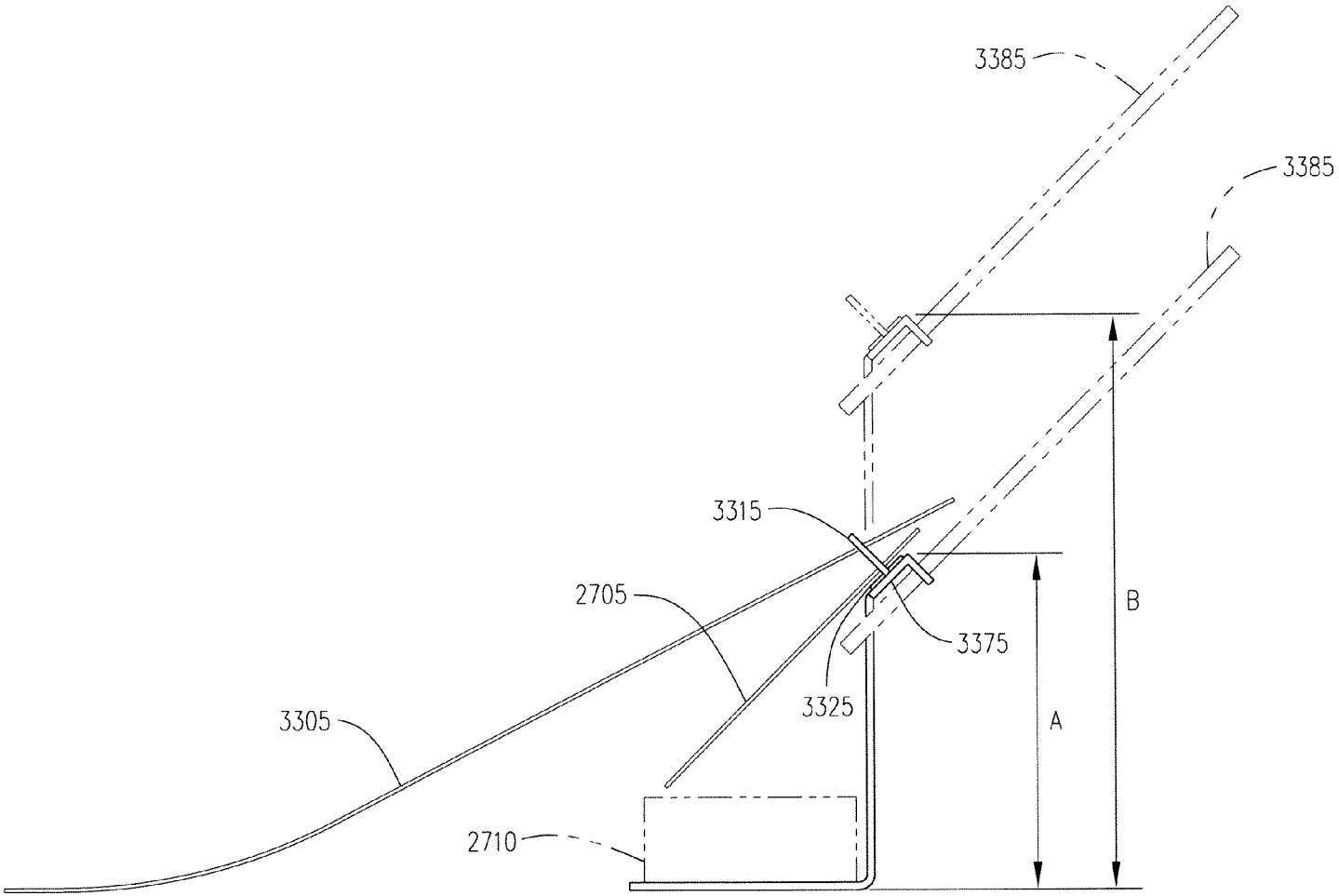
FIG. 39 contains a side view of the embodiment of FIG. 36.

FIGS. 37 and 38 illustrate in greater detail the arrangement of a preferred base of the game 3300. FIG. 39 illustrates how the height of the target loop might be adjusted depending on the desires of the user.

Figure 40:
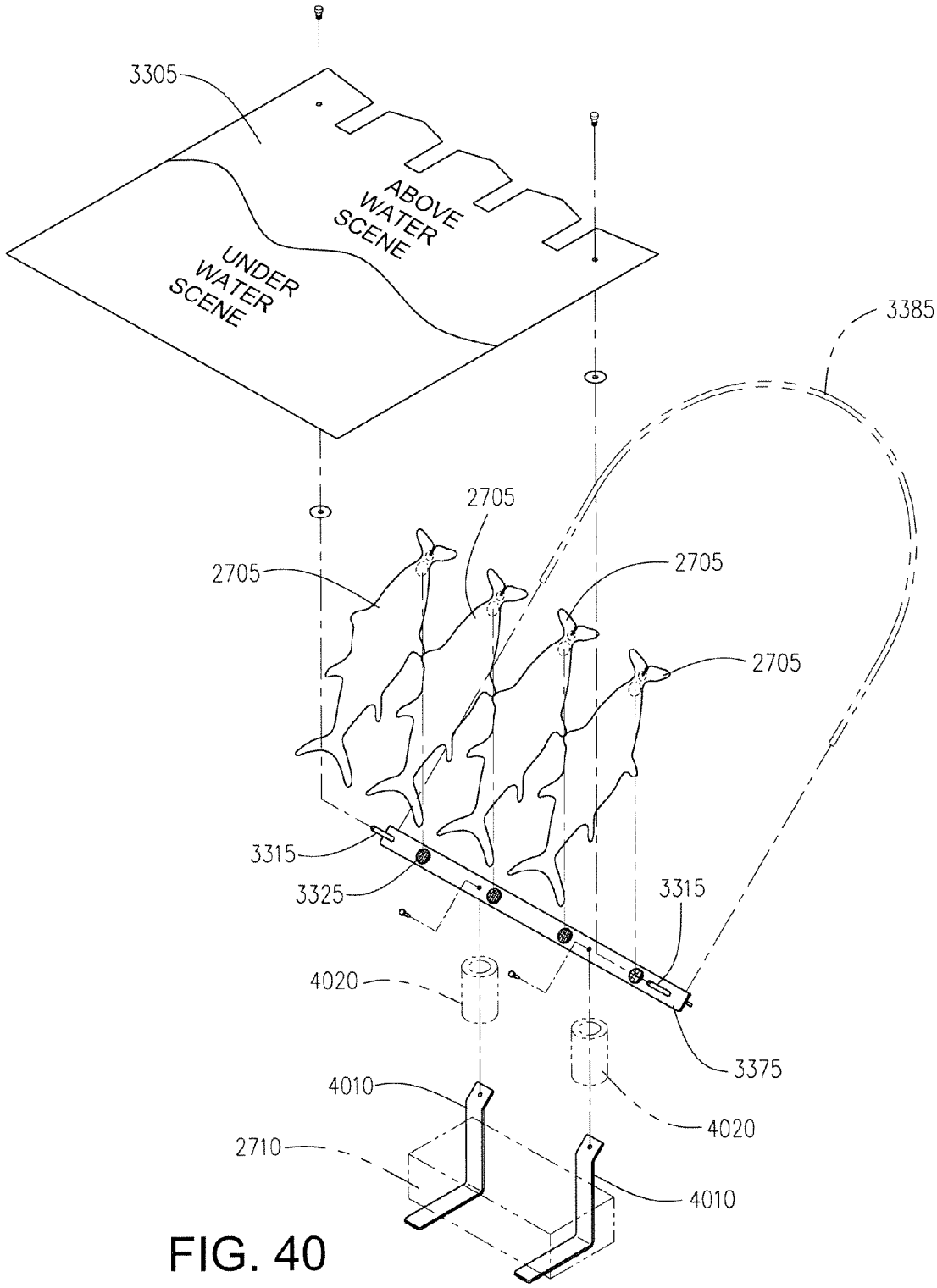
FIG. 40 contains another preferred embodiment which uses L-shaped brackets as a lower stand.

Turning next to the embodiment of FIG. 40, there is provided a fishing game substantially as illustrated above but wherein the horizontal support bar 3375 is supported by two L-shaped legs 4010. As is indicated in this figure, in one preferred arrangement, cylindrical floats 4020 will be placed over the legs 4010 in order to make the game buoyant when it is placed in water.

Figure 41A:
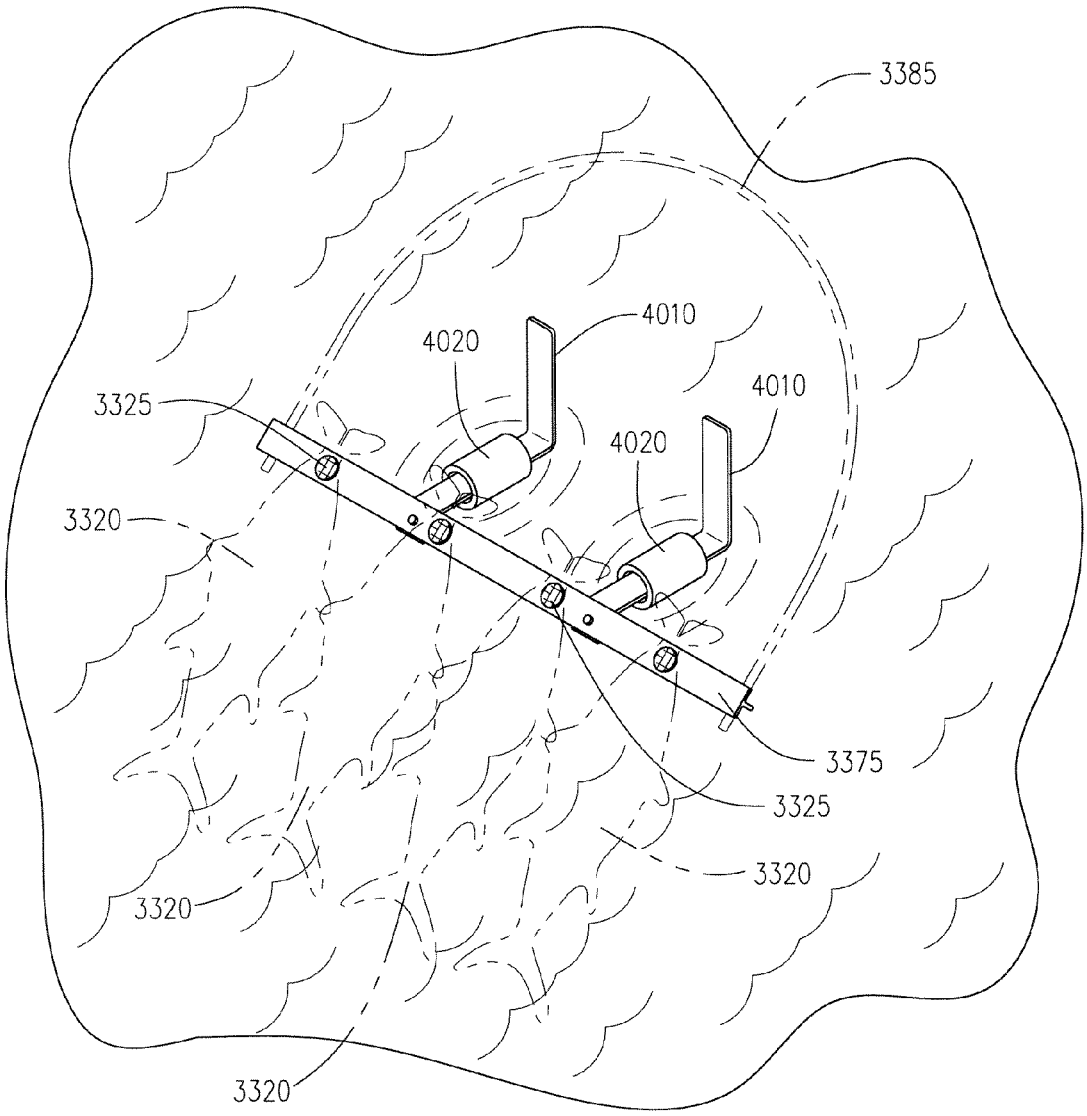
FIG. 41A illustrates the embodiment of FIG. 40 as it might appear when floating in a body of water.

In FIG. 41A, the instant embodiment is illustrated as it might appear when floating on a body of water. As is generally indicated by this figure, the cylindrical floats 4020 will tend to raise the legs above the water level and tilt the support bar 3375 forward. The game pieces 2705 will remain attached by their hook and loop connectors until the gaming angler snags one of them with a toss. In this preferred embodiment, the target hoop 3385 might be made to be buoyant to help maintain the proper orientation of the game while it floats on the surface of the water.

Figure 41B:
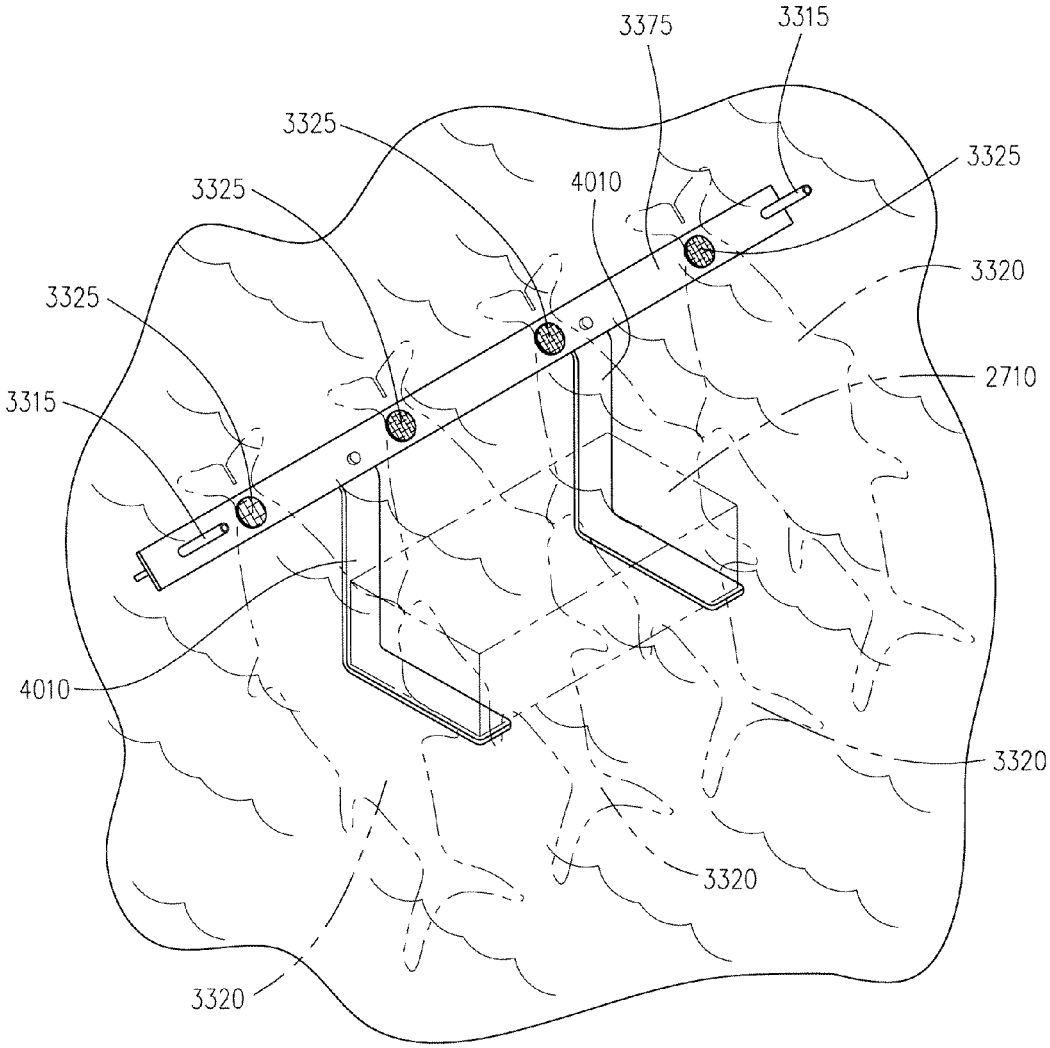
FIG. 41B illustrates the embodiment of FIG. 40 as it might appear when weighted to rest on the bottom of the body of water.

FIG. 41B illustrates how the embodiment of FIG. 40 might appear if it were partially submerged in a body of water by placing weight 2710 in the position indicated. In this arrangement, the legs 4010 rest on the bottom of the body of water and weight 2710 (e.g., a brick) might be placed on top of the horizontally extending portion of the legs 4010.

Figure 42:
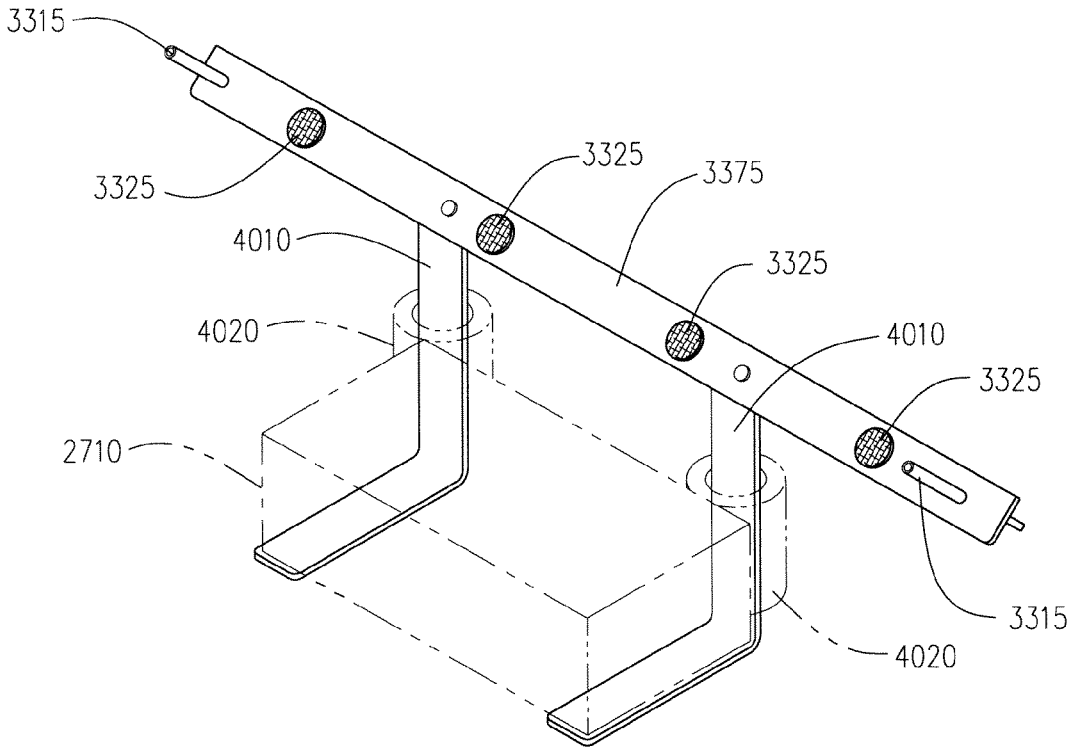
FIG. 42 contains a front view close up of the embodiment of FIG. 40.

FIG. 42 contains a close-up view of the base of the embodiment of FIG. 40. Note that both floats 4020 and weight 2710 are in place. In practice, a user would likely use one or the other but it certainly possible that the floats 4020 could be left in place and overpowered by the weight 2710. In some preferred embodiments, the floats 4020 will be made to be removable. That is not a requirement, though, and it is certainly possible that the floats 4020 might be permanently attached.

Figure 43:
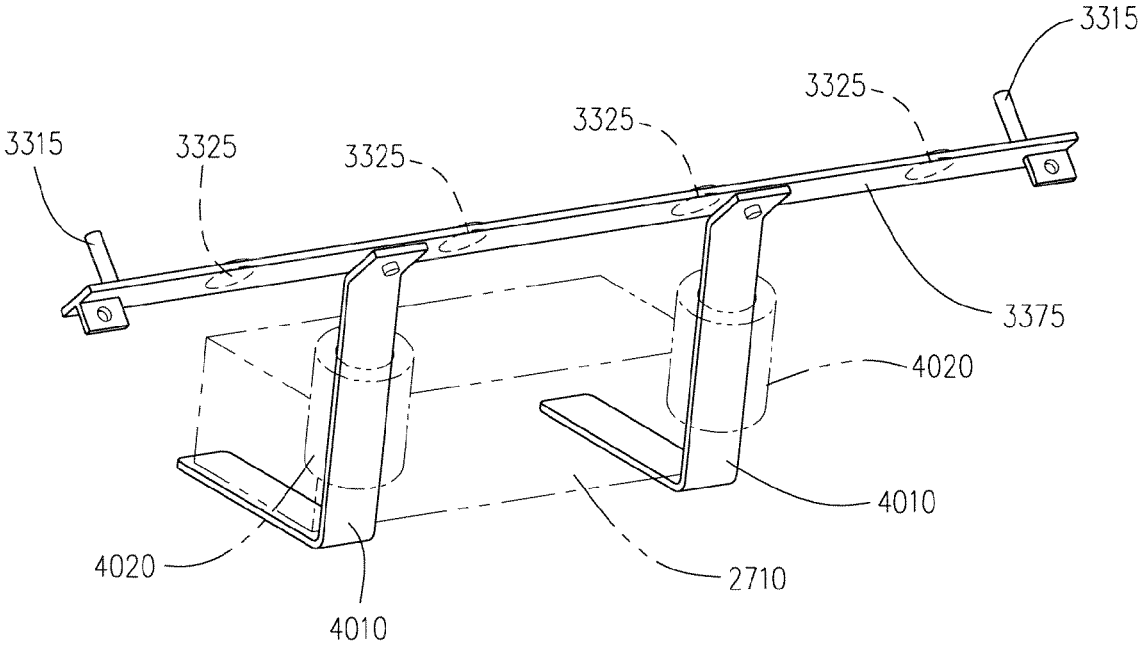
FIG. 43 contains a rear view close up of the embodiment of FIG. 40.

FIG. 43 provides the rearward view of the embodiment of FIG. 42.

Figure 44:
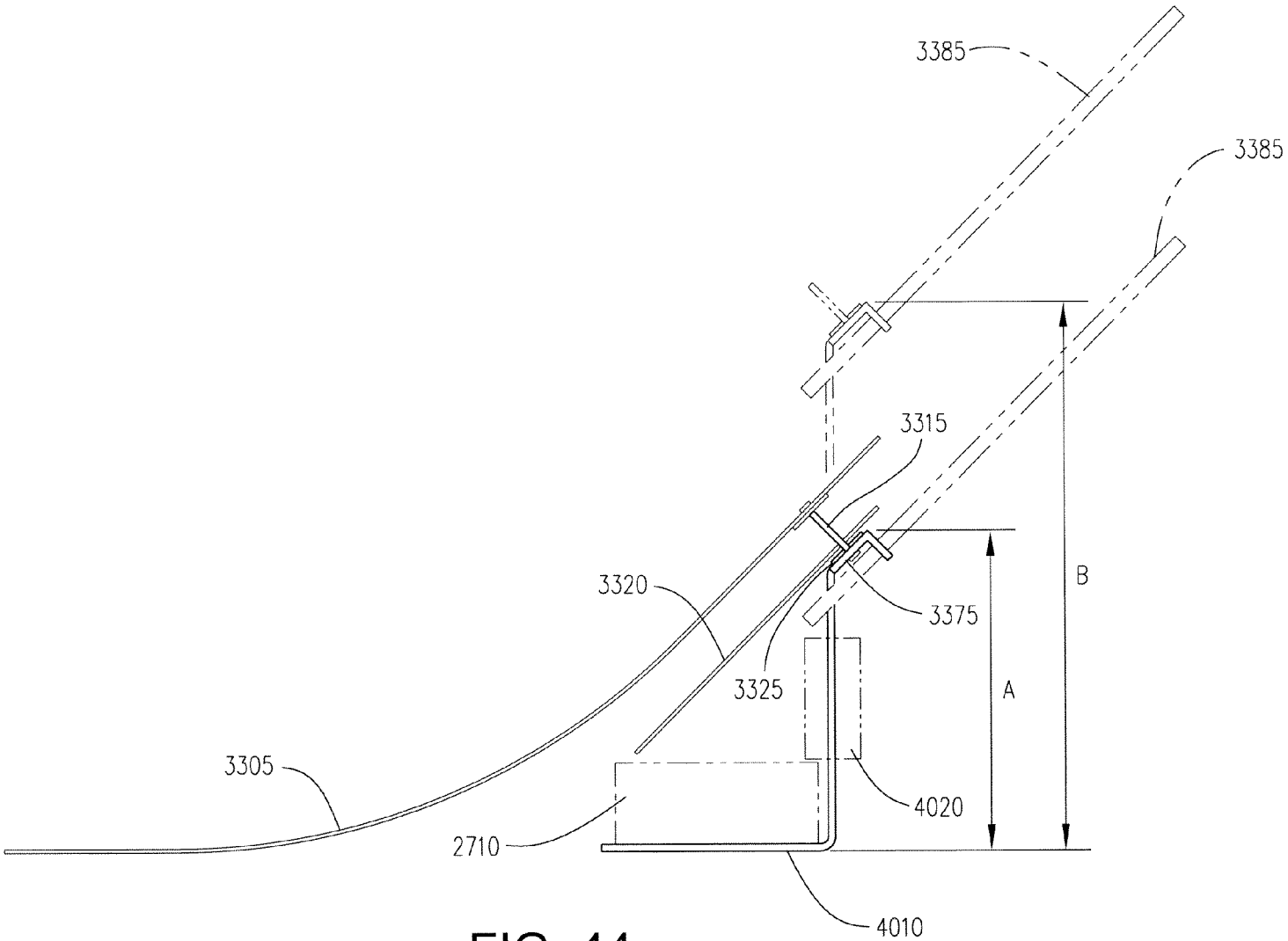
FIG. 44 contains a side view of the embodiment of FIG. 40.

Finally, FIG. 44 contains a side view of the embodiment of FIG. 40. As should be clear, the target hoop will preferably be made to be adjustable in height to accommodate, e.g., different water depths. As before, a weight 2710 and a float 4020 are both illustrated as being present although, typically, either one or the other would be used.

Thus, it is apparent that there has been provided, in accordance with the invention, a monitor and method of operation of the monitor that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A fishing game apparatus, comprising:

(a) a horizontally extending fish support;

(b) one or more fish shaped members, each having the general outline of a fish and a lower end resembling a tail of a fish, each of said fish shaped members having a representation of a fish thereon, each of said representation of a fish having a representation of fish tail proximate said lower end of said fish shaped member and a representation of a fish mouth proximate an upper end of said fish shaped member, (b1) said upper end of said fish shaped member having an outwardly flaring upper terminus extending beyond said representation of said fish mouth, said upper terminus having an angled mouth, a guide slot and a circular snare opening there, said guide slot leading from said angled mouth to said circular snare opening, (b2) each fish shaped member being connectable to the fish support by a releasable holding means, (c) a plug adapted to be connected to the end of a casting line so that the plug and line can be cast over the angled mouths of the fish shaped members, each plug being made of resilient material and being provided with a nose piece adjacent to the connection of the line to the plug, the nose piece tapering outwardly from a diameter of smaller size than the circular snare opening in the fish shaped member where the plug connects to the line to a diameter slightly larger than the diameter of the snare opening in the fish-shaped member, the plug being provided with a recess beyond the larger diameter of the nose piece so that, when the plug is pulled into the circular snare opening in the fish-shaped member, the nose piece will squeeze through the opening until the sides of the opening are received in the recess of the plug, so that pulling on the line after the plug has been received in the circular snare opening will cause the fish shaped member to pull against the releasable holding means to release the fish-shaped member from the fish support.

2. The fishing game apparatus as set forth in claim 1, further comprising:

(d) a horizontally extending cast-over back bar connected to the fish support and extending in spaced parallel relation thereto, said cast-over back bar being made floatable so that the fishing apparatus floats in the surface of the water.

3. The fishing game apparatus as set forth in claim 1 further comprising (e) a vertical support having an upper end and a lower end, (e1) the upper end of the vertical support being connected to the horizontal fish support;

(e2) the lower end of the vertical support supporting the fishing apparatus from the ground;

(f) a horizontal supporting pipe located forward and below the horizontal fish support and parallel thereto;

(f1) the horizontal supporting pipe having an inclined flat surface which extends for the length of pipe;

(g) a horizontal connecting pipe extending from the vertical support and at right angles thereto to the horizontal supporting pipe at right angles thereto;

(h) a flat, essentially upright game board having an upper end and a lower end;

(h1) the upper end of the game board resting against the horizontal fish support and over the fish thereon;

(h2) the lower end of the game board resting against the inclined flat surface and being adhesively connected thereto;

(h3) the game board having a gap therein which is in alignment with the guide slot in the fish shaped member, the gap in the game board being disposed between a pair of doors which are mounted on hinge axes for swinging movement when a fish-shaped member is pulled against the doors, and, (h4) the game board being tapered inwardly on opposite sides of the gap so that a fisherman, if he gets his line over the upper end of the game board, can manipulate the line by sideways tugging into the gap and thereafter into the guide slot, and continued pulling on the line will cause the fish shaped member to be released from the fish support and to spring out through the hinged doors in a manner simulating the catching of fish in actual water.

4. The fishing game apparatus as set forth in claim 3 wherein the game board is provided with a flexible and adjustable plastic loop located at the upper end of the game board to provide a target for the fisherman to cast the plug between the loop and the upper end of the game board.

5. The fishing game apparatus as set forth in claim 1 wherein each fish is provided with a separable mouth piece adhesively attached to the upper end of the fish;

the separable mouth piece having therein the snare opening and the guide slot.

6. The fishing game apparatus as set forth in claim 1, wherein said horizontal fish support is made floatable so that it can float on the surface of the water.

7. A fishing game apparatus, comprising:

(a) a horizontally extending fish support;

(b) one or more game pieces, each of said game pieces having a front side and a rear side, an upper end and a lower end, said upper end of said game piece having an angled mouth tapering to a line slot, said angled mouth being configured to guide a casting line into said line slot when the game piece is oriented in an upright position, said casting line slot terminating proximate to a first engaging member situated on said rear side of each of said one or more game pieces, said first engaging member being adapted to removably engage a second engaging member, (b1) each of said one or more game pieces having a representation of a fish thereon, said representation having a lower end resembling a fish tail and an upper end resembling a fish head, said fish tail being proximate to said game piece lower end and said fish head being proximate to said game piece upper end, (b2) each of said game pieces being releasably connectable to said fish support, said fish support separately supporting each of said one or more game pieces when said one or more game pieces are so connected, and, (c) a plug adapted to be connected to the end of said casting line so that said plug, said casting line, and said second engaging member can be cast over the angled mouth of one of the one or more game pieces, said plug being made of resilient material, said second engaging member being urged by said plug toward said one or more game pieces when a user draws said plug back after a cast, said second engaging member engaging said first engaging member when said casting line is drawn through said line slot, said first and second engaging member engaging with sufficient force to cause a snared game piece to be pulled from the fish support and toward the user.

8. The fishing game apparatus off claim 7, wherein each of said game pieces has a representation of a different fish thereon.

9. The fishing game apparatus off claim 7, wherein said first engaging member is a hook material and wherein said second engaging member is a loop material.

10. The fishing game apparatus of 7, wherein at least one of said at least one game pieces is relatively thin and fish shaped, and wherein each of said at least one of said at least one game pieces has an outwardly flaring upper terminus extending beyond said representation of said fish head, said upper terminus having an angled mouth tapering to a line slot, said angled mouth being configured to guide a casting line into said line slot when the game piece is oriented in an upright position.

11. A fishing apparatus comprising (a) a horizontally extending fish support;

(b) a horizontally extending cast-over back bar connected to the fish support and extending in spaced parallel relation thereto, the fish support and back bar being made floatable so that the fish support and back bar can float on the surface of water;

(c) one or more flat, relatively thin fish shaped members, (c1) each having the general outline of a fish and a lower end resembling a tail of a fish, (c2) each of said fish shaped members having a representation of a fish thereon, each of said representation of a fish having a representation of fish tail proximate said lower end of said fish shaped member and a representation of a fish mouth proximate an upper end of said fish shaped member, (c3) said upper end of each of said fish shaped members having an outwardly flaring upper terminus extending beyond said representation of said fish mouth, said upper terminus having an angled mouth, a guide slot and a circular snare opening there, said guide slot leading from said angled mouth to said circular snare opening, and, (c4) each fish shaped member being connected to the fish support by a releasable holding means;

(d) a casting line, (e) a plug adapted to be connected to the end of the casting line so that the plug and line can be cast over the back bar and the angled mouths of the fish shaped members, each plug being made of resilient material and being provided with a nose piece adjacent to the connection of the line to the plug, the nose piece tapering outwardly from a diameter of smaller size than the circular snare opening in the fish shaped member where the plug connects to the line to a diameter slightly larger than the diameter of the snare opening in the fish-shaped member, the plug being provided with a recess beyond the larger diameter of the nose piece so that, when the plug is pulled into the circular snare opening in the fish-shaped member, the nose piece will squeeze through the opening until the sides of the opening are received in the recess of the plug, so that pulling on the line after the plug has been received in the circular snare opening will cause the fish shaped member to pull against the releasable holding means to release the fish-shaped member from the fish support.

12. The fishing apparatus as set forth in claim 11, further comprising:

(f) a vertical support having an upper end and a lower end,
  (f1) the upper end of the vertical support being connected to the horizontal fish support, and,
  (f2) the lower end of the vertical support supporting the fishing apparatus from the ground;

(g) a horizontal supporting pipe located forward and below the horizontal fish support and parallel thereto,
  (g1) the horizontal supporting pipe having an inclined flat surface which extends for the length of pipe;

(h) a horizontal connecting pipe extending from the vertical support and at right angles thereto to the horizontal supporting pipe at right angles thereto;

(i) a flat, essentially upright game board having an upper end and a lower end,
  (i1) the upper end of the game board resting against the horizontal fish support and over the fish thereon;
  (i2) the lower end of the game board resting against the inclined flat surface and being adhesively connected thereto;
  (i3) the game board having a gap therein which is in alignment with the guide slot in the fish shaped member, the gap in the game board being disposed between a pair of doors which are mounted on hinge axes for swinging movement when a fish-shaped member is pulled against the doors,
  (i4) the game board being tapered inwardly on opposite sides of the gap so that a fisherman, if he gets his line over the upper end of the game board, can manipulate the line by sideways tugging into the gap and thereafter into the guide slot, and continued pulling on the line will cause the fish shaped member to be released from the fish support and to spring out through the hinged doors in a manner simulating the catching of fish in actual water.

13. The fishing apparatus as set forth in claim 9 wherein the game board is provided with a flexible and adjustable plastic loop located at the upper end of the game board to provide a target for the fisherman to cast the plug between the loop and the upper end of the game board.

14. The fishing apparatus as set forth in claim 11 wherein each fish shaped member is provided with a separable mouth piece adhesively attached to the upper end of the fish, the separable mouth piece having therein the snare opening and the guide slot.

15. A fishing apparatus comprising (a) a horizontally extending fish support;

(b) a horizontally extending cast-over back bar connected to the fish support and extending in spaced parallel relation thereto,
  (b1) the fish support and back bar being made floatable so that the fish support and back bar can float on the surface of water;

(c) one or more flat, relatively thin fish shaped members, each having the outline of a fish and each having an upper end forming an angled mouth and a lower end resembling the tail of a fish, each fish shaped member having a circular snare opening therein mounted directly below the mouth of the fish shaped member and a guide slot leading from the mouth of the fish-shaped member to the circular snare opening, each fish shaped member being connected to the fish support by a releasable holding means;

(d) a casting line;

(e) a plug adapted to be connected to the end of the casting line so that the plug and line can be cast over the back bar and the angled mouths of the fish shaped members, each plug being made of resilient material and being provided with a nose piece adjacent to the connection of the line to the plug, the nose piece tapering outwardly from a diameter of smaller size than the circular snare opening in the fish shaped member where the plug connects to the line to a diameter slightly larger than the diameter of the snare opening in the fish-shaped member, the plug being provided with a recess beyond the larger diameter of the nose piece so that, when the plug is pulled into the circular snare opening in the fish-shaped member, the nose piece will squeeze through the opening until the sides of the opening are received in the recess of the plug, so that pulling on the line after the plug has been received in the circular snare opening will cause the fish shaped member to pull against the releasable holding means to release the fish-shaped member from the fish support;

(f) a vertical support having an upper end and a lower end,
  (f1) the upper end of the vertical support being connected to the horizontal fish support, and,
  (f2) the lower end of the vertical support supporting the fishing apparatus from the ground;

(g) a horizontal supporting pipe located forward and below the horizontal fish support and parallel thereto,
  (g1) the horizontal supporting pipe having an inclined flat surface which extends for the length of pipe;

(h) a horizontal connecting pipe extending from the vertical support and at right angles thereto to the horizontal supporting pipe at right angles thereto;

(i) a flat, essentially upright game board having an upper end and a lower end,
  (i1) the upper end of the game board resting against the horizontal fish support and over the fish thereon,
  (i2) the lower end of the game board resting against the inclined flat surface and being adhesively connected thereto,
  (i3) the game board having a gap therein which is in alignment with the guide slot in the fish shaped member, the gap in the game board being disposed between a pair of doors which are mounted on hinge axes for swinging movement when a fish-shaped member is pulled against the doors, and,
  (i4) the game board being tapered inwardly on opposite sides of the gap so that a fisherman, if he gets his line over the upper end of the game board, can manipulate the line by sideways tugging into the gap and thereafter into the guide slot, and continued pulling on the line will cause the fish shaped member to be released from the fish support and to spring out through the hinged doors in a manner simulating the catching of fish in actual water.

16. The fishing apparatus as set forth in claim 15 wherein the game board is provided with a flexible and adjustable plastic loop located at the upper end of the game board to provide a target for the fisherman to cast the plug between the loop and the upper end of the game board.

17. The fishing apparatus as set forth in claim 15 wherein each fish is provided with a separable mouth piece adhesively attached to the upper end of the fish, the separable mouth piece having therein the snare opening and the guide slot.

18. A fishing game piece for use with a casting line having a plug affixed thereto, comprising:

(a) a flat, relatively thin body having the general outline of a fish, said body having an upper end and a lower end, wherein said lower end is shaped to resemble a tail of a fish, said body has a visually perceptible representation of a fish thereon, said representation of said fish has a representation of fish tail proximate said lower end of said body and a representation of a fish head proximate said upper end of said body, said upper end of said body has an outwardly flaring upper terminus extending beyond said representation of said fish head, said upper terminus having an angled mouth, a guide slot and a circular snare opening there, said guide slot leading from said angled mouth to said circular snare opening, said angled mouth and said guide slot being sized to accommodate the casting line, and said circular snare being sized such that the plug cannot readily pass through;

(b) a releasable holding means affixed to said body, said releasable holding means being at least for supporting said body such that after the casting line is passed through said guide slot and into said circular snare opening, pulling the casting line through said circular snare opening will cause said holding means to release after the plug engages said circular snare opening, thereby allowing said body to travel along with the plug if the casting line is pulled further.

* * * * *